United States Patent [19]

Krueger

[11] Patent Number: 4,621,974

[45] Date of Patent: Nov. 11, 1986

[54] AUTOMATED PIPE EQUIPMENT SYSTEM

[75] Inventor: Roger J. Krueger, Arvada, Colo.

[73] Assignee: InPro Technologies, Inc., Arvada, Colo.

[21] Appl. No.: 537,684

[22] PCT Filed: Aug. 9, 1983

[86] PCT No.: PCT/US83/01217

§ 371 Date: Oct. 6, 1983

§ 102(e) Date: Oct. 6, 1983

[87] PCT Pub. No.: WO84/00789

PCT Pub. Date: Mar. 1, 1984

Related U.S. Application Data

[63] Continuation-in-part of Ser. No. 408,795, Aug. 17, 1982, Pat. No. 4,531,875.

[51] Int. Cl.[4] ..... E21B 19/14

[52] U.S. Cl. ..... 414/786; 414/22; 414/745

[58] Field of Search ..... 414/22, 745, 786; 175/52, 85

[56] References Cited

U.S. PATENT DOCUMENTS

| | | | |
|---|---|---|---|
| Re. 27,129 | 6/1971 | Lemelson . | |
| Re. 30,071 | 8/1979 | Hilding et al. | 175/52 |
| 2,773,605 | 12/1956 | De Jarnett . | |
| 3,680,412 | 8/1972 | Mayer et al. | 81/57.34 |
| 3,702,640 | 11/1972 | Cintract et al. | 175/85 |
| 3,780,883 | 12/1973 | Brown . | |
| 3,795,326 | 3/1974 | Neilon et al. . | |
| 3,828,943 | 8/1974 | Simon . | |
| 3,845,284 | 10/1974 | Taguchi et al. | 235/150.1 |
| 3,870,165 | 3/1975 | Besijn . | |
| 3,874,518 | 4/1975 | Swoboda, Jr. et al. . | |
| 3,913,753 | 10/1975 | Swartz et al. . | |
| 3,939,990 | 2/1976 | Johnson . | |
| 4,013,178 | 3/1977 | Brown et al. . | |
| 4,037,672 | 7/1977 | Hodge | 173/157 |
| 4,042,123 | 8/1977 | Sheldon et al. . | |
| 4,077,525 | 3/1978 | Callegari et al. . | |
| 4,117,941 | 10/1978 | McCleskey, Jr. et al. . | |
| 4,128,135 | 12/1978 | Mitchhart et al. | 175/52 |
| 4,128,888 | 12/1978 | Sheldon et al. | 364/565 |
| 4,139,891 | 2/1979 | Sheldon et al. | 364/567 |
| 4,163,625 | 8/1979 | Jenkins | 414/22 |
| 4,187,546 | 2/1980 | Heffernan et al. | 364/565 |
| 4,269,554 | 5/1981 | Jackson | 414/22 |
| 4,274,777 | 6/1981 | Scaggs | 414/22 |
| 4,274,778 | 6/1981 | Putnam et al. | 414/22 |
| 4,304,433 | 12/1981 | Langowski | 294/106 |
| 4,345,864 | 8/1982 | Smith, Jr. et al. | 414/22 |

*Primary Examiner*—Leslie J. Paperner

*Attorney, Agent, or Firm*—Sheridan, Ross & McIntosh

[57] ABSTRACT

An automated pipe handling system is provided to increase safety and to minimize the number of workmen required in the coupling and uncoupling of pipe stands. The system includes a programmable controller for monitoring and/or controlling devices which remove and add pipe stands to a drill column. A number of transducers are operatively connected to the controlled devices for communication with the programmable controller for use in verifying that the controlled devices have properly performed their programmed tasks. The controlled devices include upper and lower arm assemblies for use in engaging and moving the uncoupled pipe stands to a storage position. The controlled devices further include a finger board assembly and a set-back assembly. The finger board assembly moves and retains the upper portions of the pipe stands while a drill rig floor of a derrick supports their lower portions. The set-back assembly is used to hold the lower portions of the pipe stands and to move the pipe stands to the predetermined storage positions on the drill rig floor.

4 Claims, 42 Drawing Figures

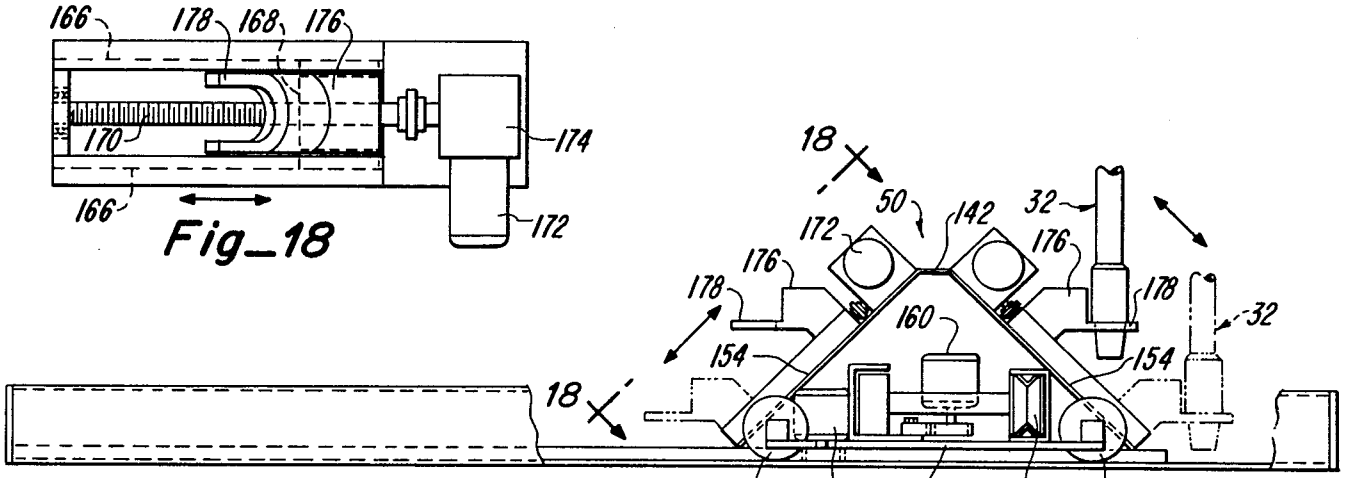
Fig_16
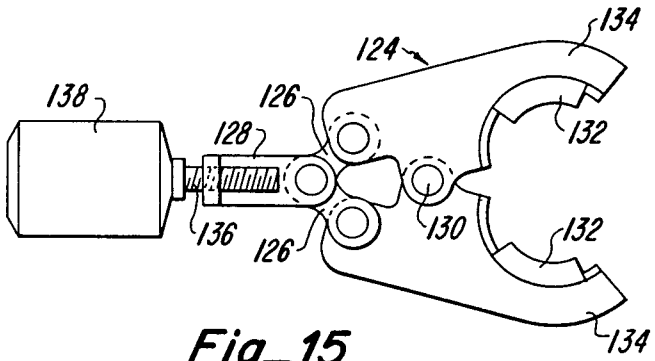
Fig_15
Fig_18
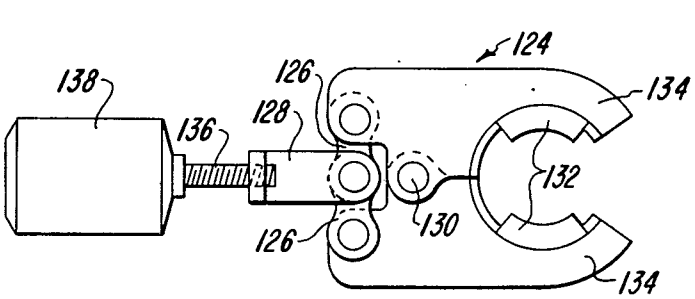
Fig_14

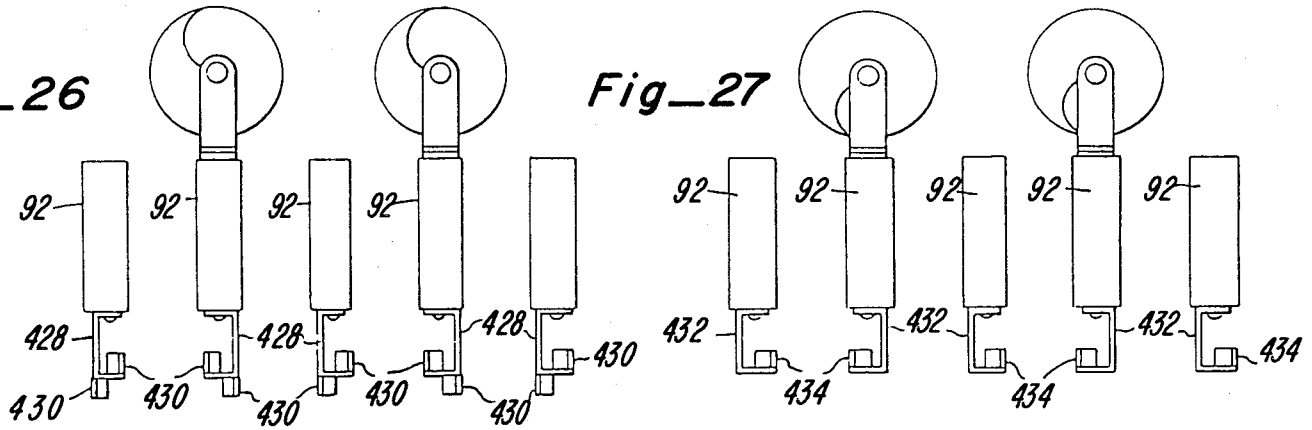
Fig_26
Fig_27
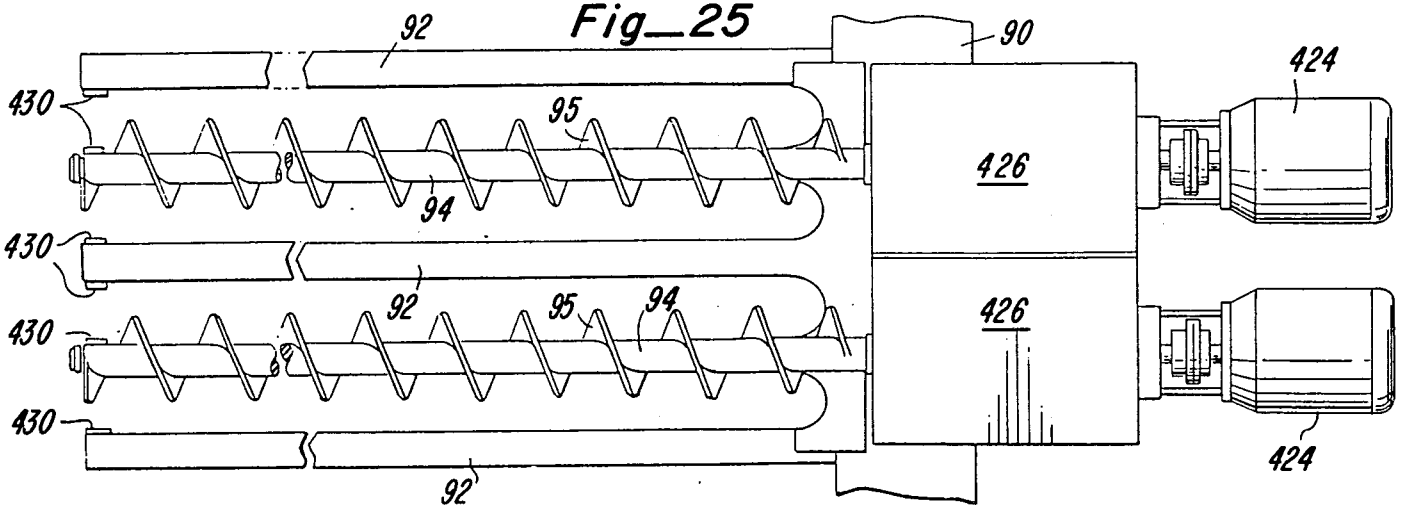
Fig_25

602
172
170
166
32
178
528
508
530
510
522
526
524
512
526
604
178
32
514
516
518
516
514
176
606

AUTOMATED PIPE EQUIPMENT SYSTEM

This is a continuation-in-part of Ser. No. 408,795, filed Aug. 17, 1982, now U.S. Pat. No. 4,531,875.

FIELD OF THE INVENTION

The present invention relates to an automated system for use in the drilling industry and, in particular, to a system for removing pipe from and providing additional pipe to a drill string, as well as for monitoring desired parameters and conditions associated with the drilling operation.

BACKGROUND ART

In drilling operations, it is common practice to remove thousands of feet of pipe from a well hole in order to replace a worn drill bit. The pipe is uncoupled and stacked as it is removed. In order to reduce the time for accomplishing the repetitive task of uncoupling and storing pipe, automation of various steps involved in the uncoupling process has resulted. Remotely controlled racking arms have been devised for gripping portions of pipes. A power torque winch has come into use for breaking the tight connection between two adjacent sections of pipe rather than applying mechanical wrenches requiring a number of workmen to do the same job. A power spinning wrench has recently come into use for rapidly rotating the pipe to be removed with respect to the drill string so that the pipe can be uncoupled and moved to temporary storage. Finger board sections have been employed on the derrick to receive upper portions of pipe stands to permit vertical storing of the pipe stands. In addition, a computerized system has been proposed which monitors the position of racker arms for grabbing pipes and controls the movement of the racker arms, as well as detecting whether jaws of the arm are open or closed.

Although the foregoing contributions to the task of uncoupling, as well as coupling, pipe stands have improved the efficiency of the drilling operation, some significant deficiencies still remain. None of the prior art systems is fully automated since verification of each step of the system operation is not automatically done before a next step is initiated. In this regard, the present invention utilizes sensing means, such as transducers, for use in indicating to a programmable controller whether a pipe stand has actually been grasped by a racking arm. There is no need for a drill rig operator to check whether this grasping step has occurred since the system itself can make such a determination. In addition, the present invention incorporates newly devised controllable arms and a transport assembly for grabbing and holding pipe stands during the uncoupling and coupling operations. These devices can be used with presently available drilling equipment which has been modified in a novel manner to provide an automatic pipe handling system.

STATEMENT RELATING TO PRIOR ART

U.S. Pat. No. 4,042,123 to Sheldon et al. issued Aug. 16, 1977 describes a digital computer system incorporated with a hydraulically powered pipe handling apparatus. The system controls and monitors the operations of pipe racking and unracking and includes sensors for use in the pipe handling process. However, it does not teach the use of transducers for providing an indication that a pipe was actually grasped. Rather, this prior art system only knows whether jaws were closed, not whether there was a pipe within the jaws when they closed.

Publication entitled "Automated Pipe Handling On Floating Drill Vessels" from *Automation In OffShore Oil Field Operation* by W. F. Roberts, Jr., J. A. Howard, H. E. Johnson (1976), also describes a pipe handling system which utilizes digital computer control. The computer is able to determine the position of controlled devices, such as pipe racking arms, using a servo system. Depending upon the determined positions of such controlled devices, the computer is able to control further operations thereof. However, this proposed system does not include, among other things, verifying means for providing information to the computer as to whether a racker arm has, in fact, grasped a pipe stand. Like the Sheldon et al. patent, this system only knows that the jaws, for example, were activated to graps a pipe stand, not whether a pipe stand was actually grasped.

U.S. Pat. No, 3,501,017 to Johnson et al. issued Mar. 17, 1970 discloses a pipe racking apparatus including a finger board having horizontally extending fingers and latches for use in holding pipe stands.

U.S. Pat. No. 3,507,405 to Jones et al. issued Apr. 21, 1970 describes a block and hook assembly for movement offset from a center line of a derrick so that the assembly will not interfere with a pipe stand positioned along the center line.

U.S. Pat. No. 3,561,811 to Turner, Jr. issued Feb. 9, 1971 relates to a pipe racking system having a number of racker arms controlled from a remote location.

U.S. Pat. No. 3,937,514 to Langowski issued Feb. 10, 1976 provides a pipe guide head having shiftable slide plates for receiving and holding pipe.

U.S. Pat. No. 3,840,128 to Swoboda Jr. et al. issued Oct. 8, 1974 relates to a telescoping pipe racking arm which has lateral, vertical, and rotational movement.

DISCLOSURE OF THE INVENTION

In accordance with the present invention, a system is provided for use in the drilling field for automatically removing stands of pipe and for providing additional stands of pipe for placement below a drill rig floor, such as in a well formed through the earth's surface or the ocean floor. The system also automatically monitors significant parameters and conditions pertinent to the drilling operation. The system includes a programmable controller which is programmed to initiate and control the workings of a number of devices operatively associated with the programmable controller. Power slips are provided for use in supporting pipe stands positioned below the drill rig floor. A pipe elevator is used to engage the upper end of a pipe stand to be uncoupled from other pipe stands. An upper arm assembly is provided adjacent to an upper portion of a derrick, which supports the drill rig floor. A lower arm assembly is positioned on the drill rig floor adjacent to the opening through which pipe stands are placed into the well. A finger board assembly is also supported at the upper portion of the derrick for cooperation with the upper arm assembly. A setback assembly is also located on the drill rig floor adjacent to the pipe stands. The controlled devices further include a power tong and a power spinner supported on the drill rig floor. In one embodiment, the power tong and the power spinner are incorporated into a single unit.

The controlled devices cooperate to remove stands of pipe which are presently positioned below the drill rig floor or, alternatively, to provide additional stands of pipe to the drill string. In removing pipe stands, the pipe elevator engages an upper portion of a pipe stand and the pipe stand is raised to a predetermined height above the drill rig floor so that the upper arm assembly can be extended to engage an upper portion of the pipe stand to thereby assist in the supporting of the pipe stand. In addition, the power slips are activated to support the pipe stands remaining below the drill rig floor. After the remaining pipe stands are supported and the upper portion of the pipe stand to be uncoupled or removed is held by the upper arm assembly, the power tong is moved to engage the pipe stand lower portion for the purpose of initially breaking the tight coupling between the raised pipe stand and the remaining pipe stands. The power spinner is used to completely uncouple the raised pipe stand from the remaining pipe stands. With regard to the uncoupling operation, the lower arm assembly is used to loosely engage the pipe stand before the pipe stand is uncoupled. After the pipe stand is uncoupled or spun loose, the lower arm assembly is raised upwardly to provide a firm grip about the lower portion of the uncoupled pipe stand. In conjunction with the upper arm assembly, the lower arm assembly next moves the uncoupled pipe stand to the set-back assembly so that, during this movement, the uncoupled pipe stand remains substantially vertical. Upon reaching the set-back assembly and with the pipe stand held by the set-back assembly, the lower arm assembly is lowered to disengage the pipe stand and then the grip of the lower arm assembly is released. The set-back assembly and upper arm assembly cooperate to move the uncoupled pipe stand in a first direction to a predetermined position relative to the drill rig floor. After reaching that position, the set-back assembly typically moves the lower portion of the pipe stand in a second direction to a predetermined position at which the pipe stand is to be stored on the drill rig floor. Before the set-back assembly moves the pipe stand lower portion in the second direction, the upper portion of the removed pipe stand is released by the upper arm assembly to the finger board assembly, which securely holds this upper portion. In accomplishing each of the steps associated with grasping and moving pipe stands, the programmable controller is provided with information using transducers, coupled to the controlled devices, regarding whether each step was actually taken before the programmable controller continues with the initiating of the next step.

For removal of additional pipe stands, the foregoing process is followed with next-to-be-stored upper portions of pipe stands being placed into the finger board assembly while previously stored upper portions of pipe stands are moved to provide space in the finger board assembly for these subsequently removed pipe stands.

In one embodiment, in order to couple additional pipe stands to the drill string, the foregoing process is essentially reversed, with the last pipe stand positioned in the finger board assembly being the first pipe stand to be selected for coupling and placement below the drill rig floor.

In view of the foregoing description, it is seen that a number of worthwhile advantages of the present invention are achieved. A system is provided for automatically removing pipe stands from and adding pipe stands to a drill string. The automated system significantly minimizes the number of workmen required in the removal and addition of pipe stands. Specifically, because of the automatic features provided, workmen are not needed to secure a pipe elevator to a pipe stand to be coupled or uncoupled to a drill string; workmen need not position the power tong and power spinner for uncoupling or coupling pipe stands; workmen are not required to activate the power slips for supporting the remaining drill string; workmen are not needed to move the upper portions of pipe stands from the pipe elevator to the finger board assembly; workmen are not needed to move the lower portion of the pipe stand between the drill rig floor on which pipe stands are stored and the opening in the drill rig floor through which the remaining pipe stands are placed into a well. Concomitantly, since workmen are not needed to perform these tasks, the present system greatly reduces the possibility of serious human injury which can occur during the foregoing described operation of removing and adding pipe stands.

BRIEF DESCRIPTION OF THE DRAWINGS

FIG. 14 is a top plan view of the jaws of the lower arm assembly in a closed position;

FIG. 15 is a top plan view of the jaws of the lower arm assembly in an opened position;

FIG. 16 is a front elevational view of an embodiment of the set-back assembly showing movement of two cups and wherein one cup is shown supporting a pipe stand;

FIG. 18 is an enlarged view showing a track along which a cup is moved;

FIG. 25 is a top plan view of another embodiment of a finger board assembly;

FIG. 26 is a front view of FIG. 25 with portions removed;

FIG. 27 is a rear view of FIG. 25 with portions removed;

DESCRIPTION OF THE PREFERRED EMBODIMENTS

Figure 1:
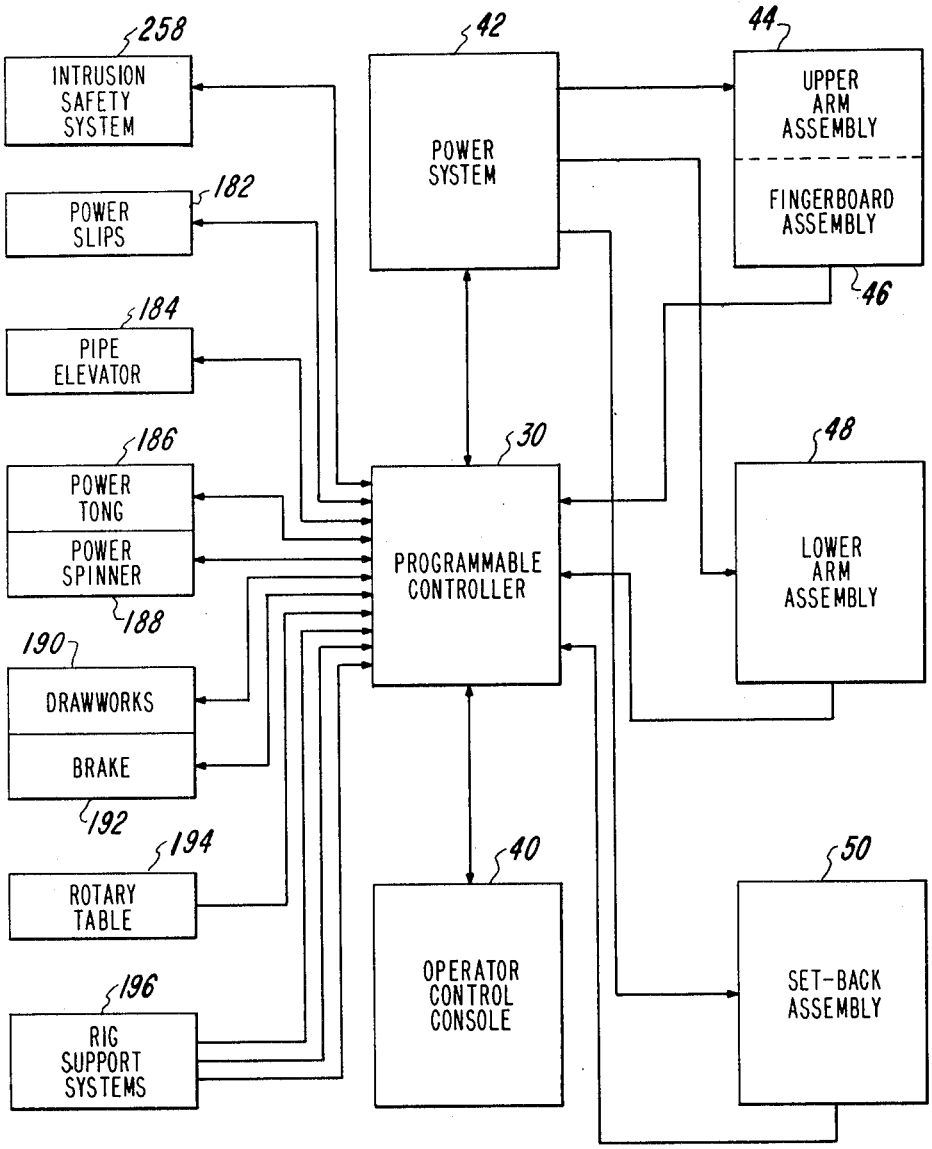
FIG. 1 is a block diagram of the automated drilling system of the present invention.

In accordance with the present invention, an automated system for use in the drilling industry is illustrated in block form in FIG. 1. The system includes a programmable controller 30 for controlling devices which are used in uncoupling or removing and coupling or adding pipe stands 32, as illustrated in FIGS. 2A–2C through 7A–7C. Each pipe stand 32 typically includes more than one pipe section 34. Pipe sections 34 are normally threadedly coupled together to form each of the pipe stands 32. After pipe stands 32 are coupled together, they are positioned through an opening formed in the drill rig floor 36. This opening is typically aligned with a well formed in the earth or a well formed through the ocean floor. In a typical operation, the length of the interconnected pipe stands 32 exceeds thousands of feet and a drill bit is joined adjacent to the lowermost pipe stand 32 for drilling the surrounding ground formation. The drill rig floor 36 is supported by a conventional derrick 38.

The programmable controller 30 is a commercially available unit, such as a Gould-Modicon programmable controller. In the present invention, the programmable controller includes newly developed software for controlling the devices relating to the removal and addition of pipe stands 32 from and to the well which is located below the drill rig floor 36.

An operator control console 40, as represented in FIG. 1, interfaces with the programmable controller 30 and is used to provide desired inputs by means of operator selection to the programmable controller 30, such as initiating the automatic sequencing of pipe stand 32 coupling. The operator control console 40 also includes visual display of certain parameters and conditions monitored by the programmable controller 30, such as the operating states of the controlled devices.

Figure 8:
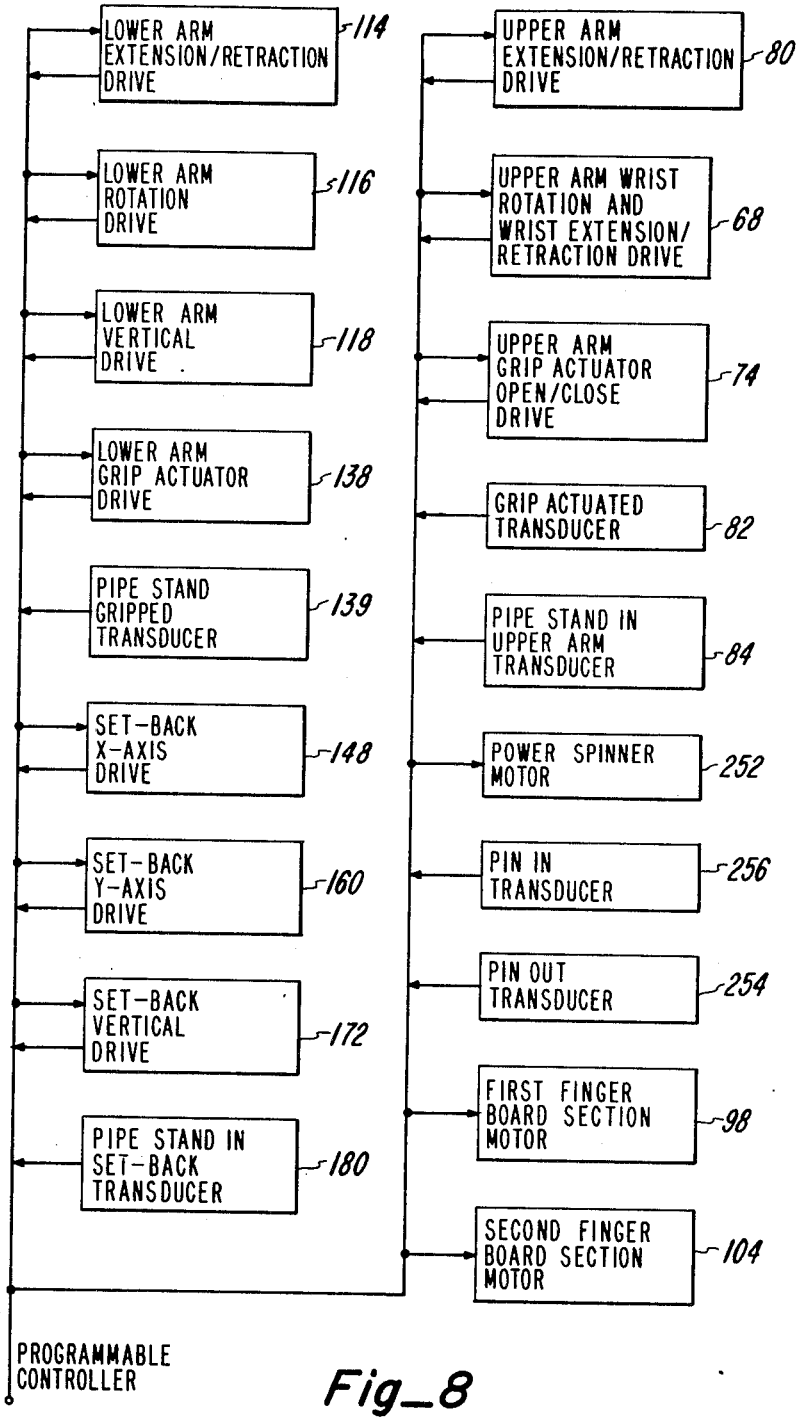
FIG. 8 is a block diagram of the drives of the present invention.

A power system 42 also communicates with the programmable controller 30 and includes a number of drives actuatable by means of control signals from the programmable controller 30. Drives used in the present invention are represented in FIG. 8, which also outlines the functions of the drives. These functional features will be described subsequently in greater detail. Each drive provides active feedback to the programmable controller 30 so that the programmable controller 30 continuously receives data information from the drives relating to the position of the particular device which the drive powers. Conventional drives can be utilized, such as are available from Gould-Gettys of Racine, Wis.

The power system 42 communicates with a number of newly devised controlled devices including an upper arm assembly 44, a finger board assembly 46, a lower arm assembly 48, and a set-back assembly 50.

Figure 9:
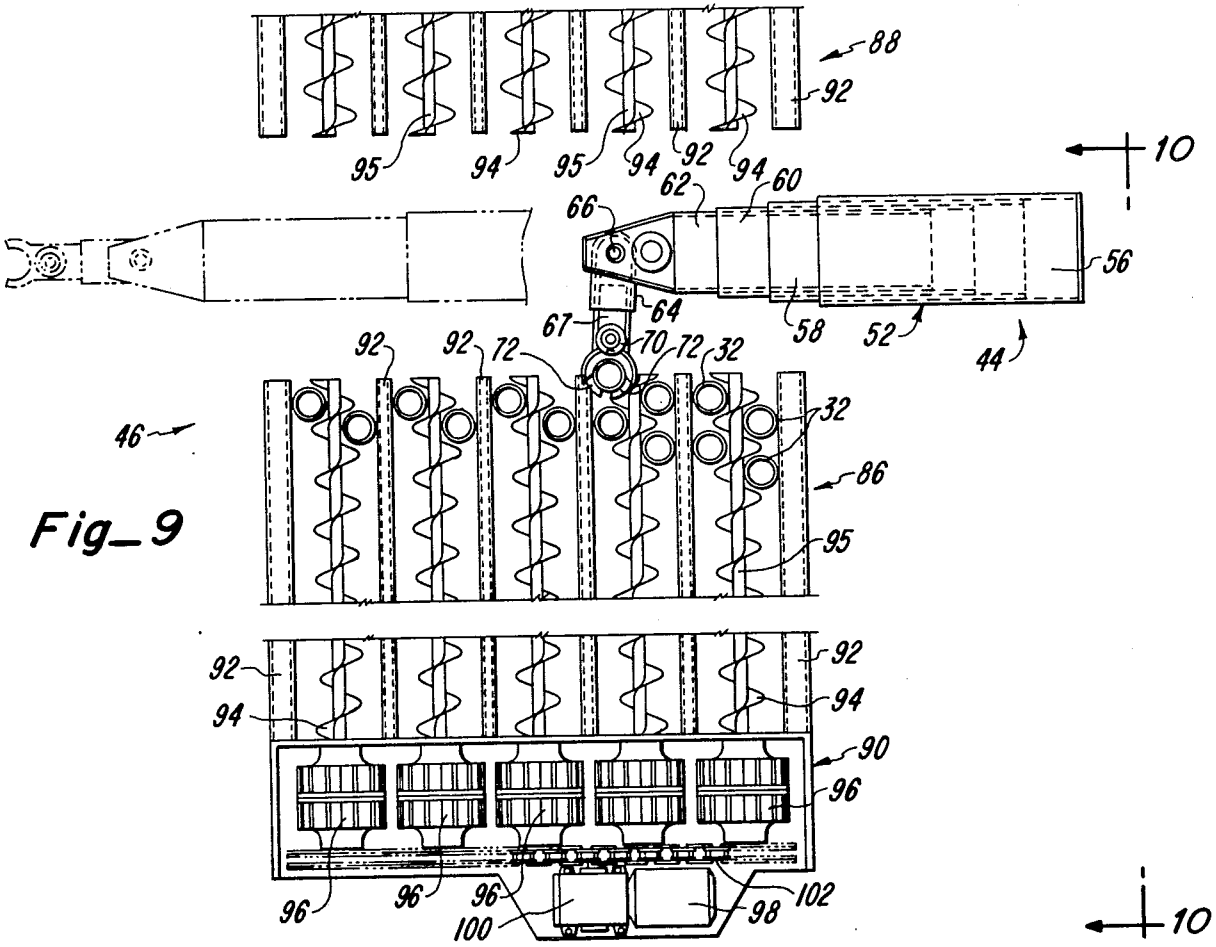
FIG. 9 is a top plan view of portions of an embodiment of a finger board assembly.
Figure 10:
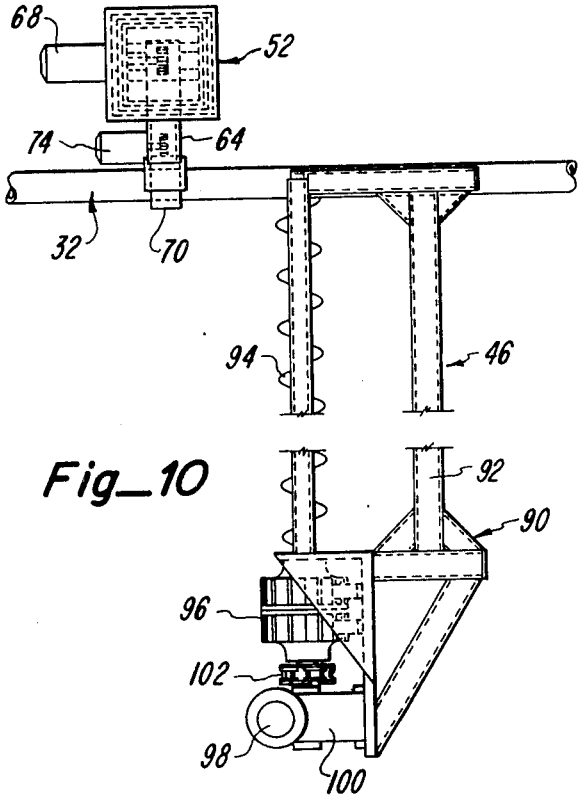
FIG. 10 is an elevational view of portions of the finger board assembly shown in FIG. 9.
Figure 11:
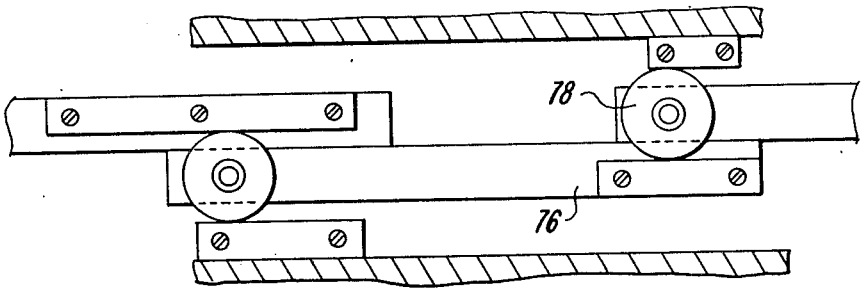
FIG. 11 is a schematic representation of a rack and pinion arrangement used for extending portions of an embodiment of the upper arm assembly.

With reference to FIGS. 9, 10, and 11, an upper arm assembly 44 includes a telescoping upper arm 52 having a main body 56, a first extendable portion 58, a second extendable portion 60, and a third extendable portion 62. A wrist 64 is joined to the end of the third extendable portion 62 by means of pivot pin 66 and includes an extendable wrist portion 67. The power for both the extension/retraction of extendable wrist portion 67 and the rotational movement of the wrist 64 is provided by a single drive 68, which is also represented in FIG. 8. In this regard, the output shaft of drive 68 rotates first to pivot the wrist 64 about pivot pin 66 and then continued rotation of the output shaft of drive 68 results in an extension of the extendable wrist portion 67.

A clamp 70 is pivotally joined to the free end of the extendable wrist portion 67. Opening and closing of jaws 72 of the clamp 70 are provided using the drive 74, which is also represented in FIG. 8. The jaws 72 are able to loosely engage the pipe stand 32 to permit vertical and rotational movement of the engaged pipe stand 32. Extension and retraction of each of the extendable portions 58, 60, 62 of upper arm 52 is provided using a rack 76 and pinion 78 arrangement driven by a drive 80, which is represented in FIG. 8.

The upper arm assembly 44 also includes a pair of transducers 82, 84, as represented in FIG. 8. Transducer 82 communicates with the programmable controller 30 and senses whether the clamp jaws 72 have been actuated to open or close. Transducer 84 also communicates with the programmable controller 30 and monitors whether a pipe stand 32 has been firmly grasped by the clamp jaws 72 so that the pipe stand 32 can be moved using the upper arm assembly 44. Unless a signal is received from transducer 84 indicating that the pipe stand 32 is held by the upper arm assembly 44, the programmable controller 30 will not initiate movement of the upper arm assembly 44 in order to transport the pipe stand 32 to a desired location.

Figure 21:
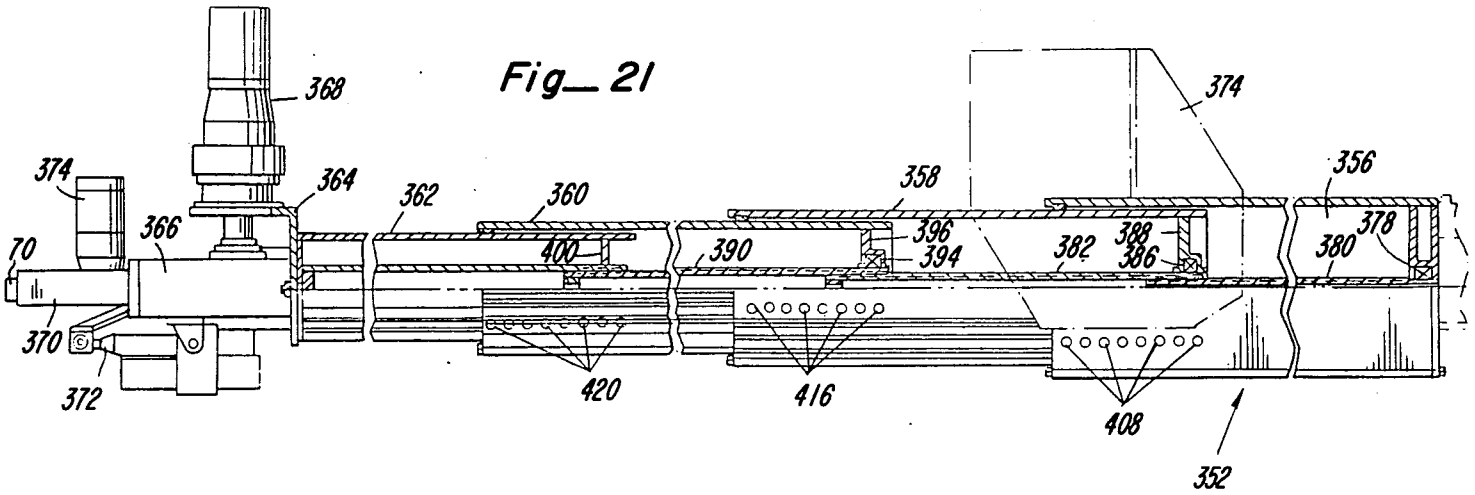
FIG. 21 is a side elevational view partially in cross-section of another embodiment of an upper arm assembly.

Another embodiment of the upper arm assembly is illustrated in FIGS. 21–24. In FIG. 21, the telescoping upper arm assembly 352 has a main body 356, a first extendable portion 358, a second extendable portion 360 and a third extendable portion 362. A plate 364 is secured to the end of extendable portion 362 and is used to support the means 366 for gripping and moving a pipe stand. A motor 368 is supported on the plate 364 and is used to rotate the means 366 and to extend portion 370 through a piston 372. Another motor 374 is mounted on portion 370 and is used to operate the jaws 72 of the clamp 70. The upper arm assembly 352 is supported by securing the main body 356 on a fixed beam 374.

Figure 23:
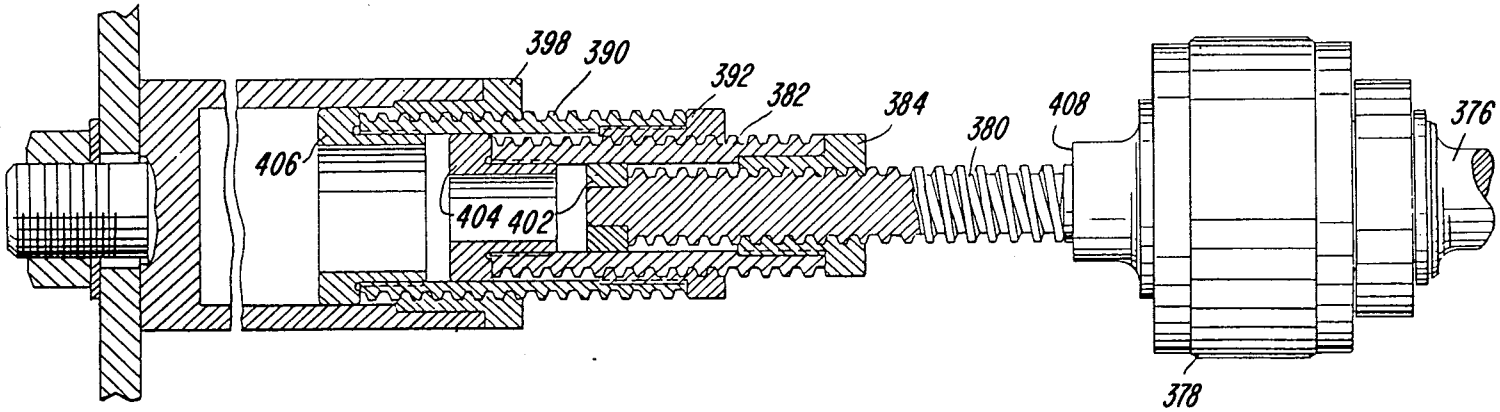
FIG. 23 is a side elevational view partially in cross-section of the drive mechanism for extending portions of the upper arm assembly.

The drive mechanism for extending the portions 358, 360 and 362 is illustrated in FIGS. 21 and 23. A shaft 376 driven by a motor (not shown) is mounted in a bearing 378 which is secured to the rear portion of the fixed main body 356. A screw 380 is joined to the shaft 376 and is also mounted in the bearing 378 so that the screw 380 may rotate relative to the main body 356. A second screw 382 has a member 384 secured to one end thereof which member 384 is provided with internal threads in engagement with the external threads of screw 380. The outer surface of the member 384 is mounted in the bearing 386 secured in the end wall 388 of extendable portion 358 so that the screw 382 may rotate relative to the extendable portion 358. A third screw 390 has a member 392 secured to one end thereof which member 392 is provided with internal threads in engagement with the external threads of screw 382. The outer surface of the member 392 is mounted in the bearing 394 secured in the end wall 396 of extendable portion 360 so that the screw 390 may rotate relative to the extendable portion 360. A member 398 is securely mounted in the end wall 400 of extendable portion 362 which member is provided with internal threads in engagement with the external threads of screw 390. The screws 380, 382 and 390 are provided with end stops 402, 404, and 406 so as to define the limit so that extendable portions 358, 360 and 362 may be extended relative to each other.

When the extendable portions 358, 360 and 362 are in a closed position nested in the main body 356, the member 384 will be adjacent to the surface 408; the member 392 will be adjacent to the member 384 and the member 398 will be adjacent to the member 392. As the shaft 376 is rotated, the screw 380 rotates therewith and through the internal threads of the member 384 starts movement of the members 384, 392 and 398 along the axis of the screw 380 and therefore starts the movement of the extendable sections 358, 360 and 362 out of the main body 356. This movement will continue until the member 384 contacts the stop 402 and prevents further extension of the extendable portion 358. At this point, the member 384 and therefore the screw 382 will start rotating with the screw 380 to start movement of the members 392 and 398 along the axis of the screw 382 and therefore start the movement of the extendable portions 360 and 362 out of the extended portion 360. This movement will continue until the member 384 contacts the stop 404 and prevents further extension of the extendable portion 360. At this point, the member 392 and therefore the screw 390 will start rotating with the screws 382 and 380 and through the internal threads of member 398 starts movement of the member 398 along the axis of the screw 390 and therefore starts the movement of the extendable portion 362 out of the extended portion 360. This movement will continue until the member 398 contacts the stop 406 and prevents further extension of the extendable portion 162. At this point, the upper arm assembly is in a fully extended position.

The foregoing mode of extension of the extendable portions of the upper arm assembly is preferred but it is not essential to the operation of the upper arm assembly. For example, the screws 380, 382 and 390 may initially commence rotating together so that the extendable portion 362 will be the first portion to be extended. It is only necessary that, when the screw 380 makes one revolution, the extendable portions 358, 360 and 362 are moved a distance equal to the pitch of the screw 380. This movement permits the means rotating the screw 350 to be controlled so that the location of the jaws 72 or the pipe gripping means may be positioned where desired. In order to ensure this operation, each screw 380, 382 and 390 has the same pitch.

Figure 24:
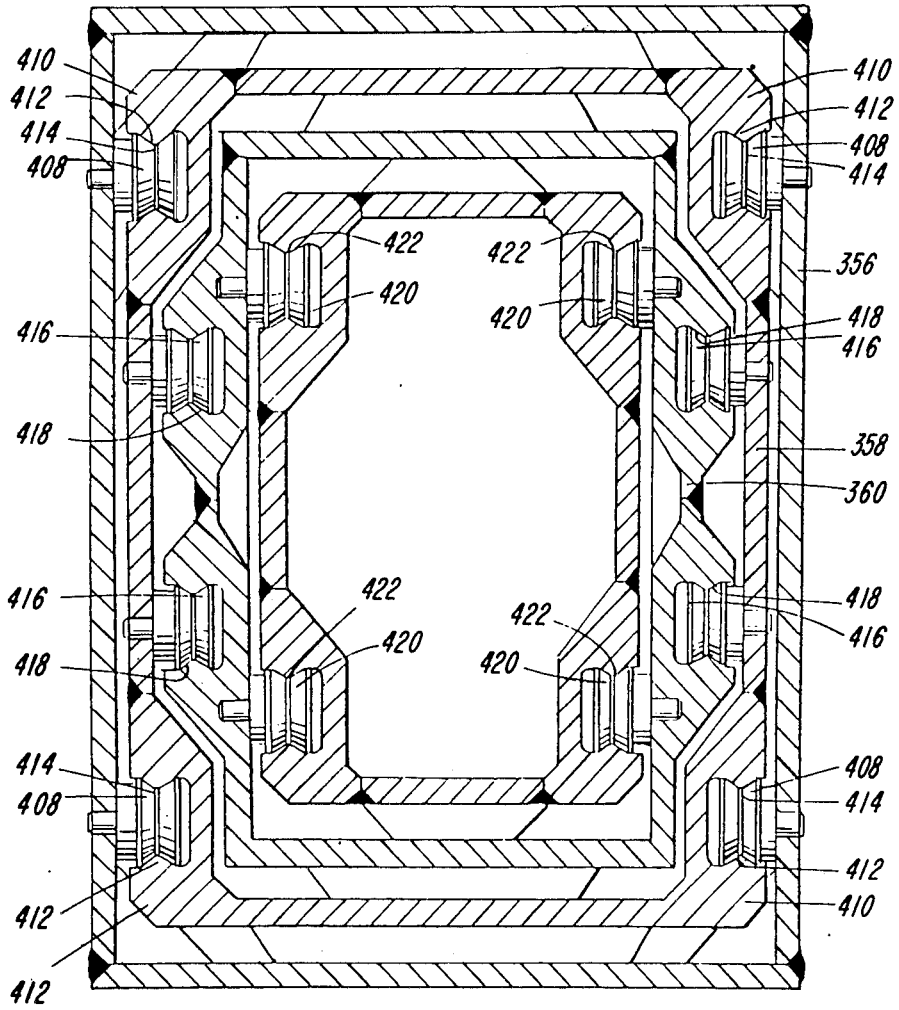
FIG. 24 is a cross-sectional view of a support structure for portions of the upper arm assembly.

In FIG. 24, there is illustrated the mechanisms which provide support for the extendable portion 358, 360 and 362 while holding friction relatively low. A plurality of rollers 408 are mounted at different locations on the inner sidewalls of the main body 356. A plurality of tracks 410 are provided in the outer surfaces of extendable portion 358 and the extendable portion 358 and main body are assembled so that the rollers 408 are in the tracks 410. As illustrated in FIG. 24, the surface of the tracks 410 have a protrusion 412 which is received in mating recesses 414 in the rollers 408. A plurality of rollers 416 are mounted at different locations on the inner sidewalls of the extendable portion 358. A plurality of tracks 418 are provided in the outer surfaces of the extendable portion 360. And, the extendable portion 360 and the extendable portion 358 are assembled so that the rollers 416 are in the tracks 418. As illustrated, the tracks 418 have protrusions and the rollers 416 mating recesses. A plurality of rollers 420 are mounted at different locations on the inner sidewalls of extendable portion 360. A plurality of tracks 422 are provided in the outer surfaces of the extendable portion 362. And, the extendable portion 362 and the extendable portion 360 are assembled so that the rollers 420 are in the tracks 422. As illustrated, the tracks 422 have protrusions and the rollers 420 mating recesses.

Figure 22:
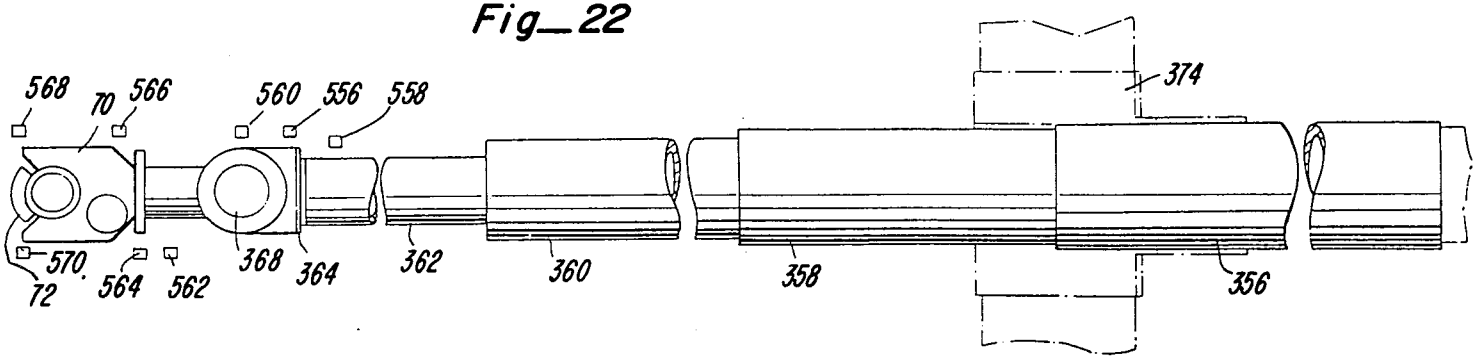
FIG. 22 is a top plan view of the upper arm assembly.

FIG. 22 also schematically shows a number of transducers for use in informing the programmable controller 30 as to the operation of the upper arm assembly 44. Specifically, transducer 556 is used in connection with the means 366 in determining its location relative to the remaining portions of the upper arm assembly 44. That is, transducer 556 informs the programmable controller 30 that means 366 is in axial alignment with the remaining extendable portions of the upper arm assembly 44. Similarly, transducer 558 informs the programmable controller that the means 366 is at a right angle relative to the extendable portions of the upper arm assembly 44 while transducer 560 informs the programmable controller 30 that the means 366 is at a right angle to the extendable portions of the upper arm assembly 44, but in a different direction than the direction used in connection with transducer 558. Transducer 562 informs the programmable controller that the means 366 is extended to a position for removing pipe stands 32 or adding pipe stands 32 to a desired screw conveyor 94. Transducer 564 informs the programmable controller 30 that the means 366 is retracted to a position such that the means 366 can be moved from out of axial alignment into axial alignment with the extendable portions of the upper arm assembly 44. The transducer 566 is located on the clamp 70 adjacent to the jaws 72 and detects when a pipe stand 32 is positioned within the clamp 70. If no detection is made by the transducer 566, the programmable controller 30 knows that the pipe stand 32 was not where it was expected. The transducers 568, 570, respectively, inform the programmable controller whether the clamp 70 is open or closed.

Also referring to FIGS. 9 and 10, as well as the schematic representations depicted in FIGS. 2A–2C through 7A–7C, details of the finger board assembly 56 are described. In the preferred embodiment, the finger board assembly 46 includes a first finger board section 86 and a second finger board section 88. The two finger board sections 86, 88 are separated so that a space is provided for movement of the upper arm assembly 44 therebetween. Each finger board section 86, 88 includes the same structural elements including a frame 90 having a number of supports 92 connected to the frame 90. Each frame 90 is supported relatively adjacent to the center or midportion of the derrick 38 and extends partially, laterally across the derrick 38. A screw conveyor 94 is held between each of the supports 92 and extends throughout the length of the supports 92. Each screw conveyor includes a plurality of helicoidal surfaces 95. A clutch brake 96 is operatively connected to each of the screw conveyors 94. A predetermined clutch brake 96 is selectable for use in driving a desired screw conveyor 94. With respect to the first finger board section 86, the energization of motor drive 98 is controlled by the programmable controller 30 and the motor drive 98 is used to provide power to the selected screw conveyor using the clutch brake 96 which has been activated by the programmable controller 30. The input to the clutch brakes 96 from the motor drive 98 is coupled through a reduction gear 100 and a chain and sprocket drive 102. With respect to the second finger board section 88, and in a similar manner, a motor drive 104 is energized to drive the selected screw conveyor 94. Both the first finger board section motor drive 98 and the second finger board section motor drive 104 are schematically represented in FIG. 8. It is understood that, although each finger board section 86, 88 is shown including five screw conveyors 94, any different number of screw conveyors 94 could be utilized and controlled by means of the programmable controller 30.

Another embodiment of the finger board sections 86, 88 is illustrated in FIGS. 25–27. Each screw conveyor 94 is operatively connected to an individual driving means 424, such as a motor, through suitable mechanisms 426. In FIG. 26, there is illustrated the front sensing means associated with the finger board. A bracket 428 is attached to the bottom of the supports 92. A pair of sensing elements 430 are mounted to face each other and are located adjacent the pipe stand transferring portion of the finger board. As illustrated in FIG. 26, the sensing elements 430 can be mounted as desired, so long as they face each other. Other types of sensing elements may be used as long as they sense the presence of the pipe stand 32. When a pipe stand 32 is sensed, the drive means 424 will operate and turn the screw conveyor 94 one-half turn. The back section of the finger board is illustrated in FIG. 27 and shows brackets 432 attached to the bottom of the supports. A pair of sensing elements 434 are mounted to face each other and function to sense the pipe stand 32. When the pipe stand 32 is sensed by the sensing elements 434, the computer knows that that portion of the finger board is full with pipe stands 32. As illustrated in FIG. 27, sensing elements 434 are located only on one side of the screw conveyor 94.

The lower arm assembly 48 is shown in detail in FIGS. 12–15 and is also schematically represented in FIGS. 2A–2C through 7A–7C. The lower arm assembly 48 includes a base 106 supported on the drill rig floor 36. A connecting member 108 interconnects the base 106 and a telescoping lower arm 110 having an extendable portion 112. A drive 114 is used to extend and retract the extendable arm portion 112. The drive 114 is operatively coupled to a screw threaded member 115 to threadedly move the threaded member 115 relative to a drive nut 117, which is connected to an end of the extendable portion 112. The lower arm 110 is also rotatable in a horizontal plane, the lower arm 110 being driven by a drive 116. The drive 116 is coupled to a reduction gear 119 which is used to operate a spur gear 121. The spur gear 121 operatively engages another spur gear 123, which is operatively joined to the connecting member 108. The lower arm 110 is also movable in a vertical plane using a drive 118. The output of drive 118 is coupled to a reduction gear 120. The reduction gear 120 is used to operate a drive nut (not shown) which engages a screw threaded member 122 carried by the connecting member 108 to raise and lower the lower arm 110.

Figure 13:
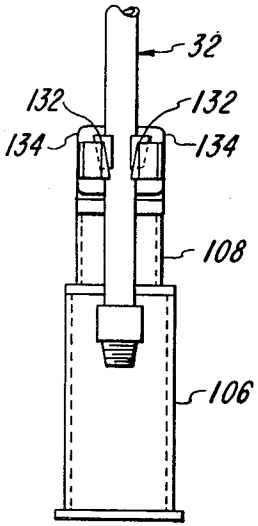
FIG. 13 is a front elevational view of the lower arm assembly grasping a pipe stand.
Figure 12:
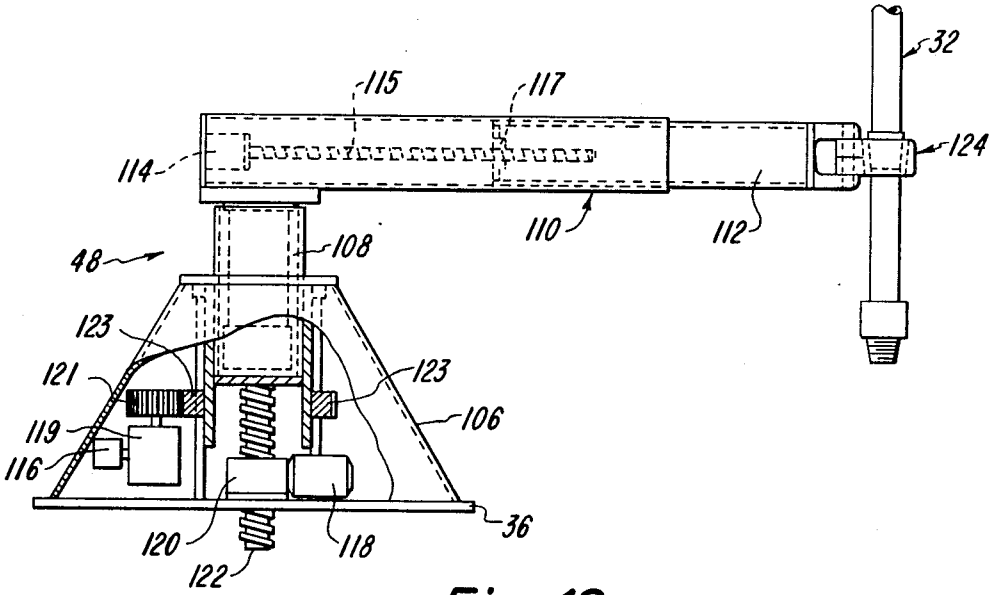
FIG. 12 is a side elevational view of an embodiment of the lower arm assembly grasping a pipe stand.

A clamp assembly 128 is attached to the free end of the lower arm extendable portion 112. The clamp assembly 124 includes toggle joints 126, as best seen in FIGS. 14 and 15. The clamp assembly 124 further includes a link member 128, a pivot member 130, and a pair of jaw slips 132 mounted on a pair of jaws 134. One end of the link member 128 is operatively joined to the free end of a threaded shaft 136 which is driven by a drive 138, also represented schematically in FIG. 8 The opposite end of the link member 128 is operatively connected to the toggle joints 126. When the link member 128 is driven by the drive 138 to the right (with reference to FIG. 14) relative to the drive 138, the jaws 134 pivot about pivot member 130 and begin to assume a closed position for grasping a pipe stand 32. The jaws 134 are able to loosely hold the lower portion of the pipe stand 32, during the tightening or loosening of a pipe stand 32 to or from another pipe stand 32, in order to permit rotational movement of the pipe stand 32. However, in order to move an uncoupled pipe stand 32, the jaws 34 must firmly grasp the uncoupled pipe stand 32. To accomplish this requirement, the jaw slips 132 are activated to fixedly hold the pipe stand 32. The jaw slips 132 are so activated by moving the lower arm 110 in an upward direction relative to the uncoupled pipe stand 32. This upward movement of the lower arm 110 causes the jaw slips 132 to wedge in against the lower portion of the uncoupled pipe stand 32 and firmly engage the same, as seen in FIG. 13. Correspondingly, the engagement by the jaw slips 132 of the uncoupled pipe stand 32 can also be provided by a downward movement of the pipe stand 32 relative to the jaw slips 132. Conversely, disengagement of the jaw slips 132 from the pipe stand 32 is provided by a relative downward movement of the lower arm 110 or a relative upward movement of the pipe stand 32.

When the link member 128 is driven by the drive 138 to the left (with reference to FIG. 15) relative to the drive 138, the jaws 134 and jaw slips 132 assume an opened position so that a pipe stand 32 held thereby is released.

The lower arm assembly 48 also includes a transducer 139, represented in FIG. 8. The transducer 139 monitors whether the lower arm assembly 48 and, in particular, jaw slips 132 have firmly engaged the lower portion of an uncoupled pipe stand 32. Prior to initiating movement of the uncoupled pipe stand 32, the programmable controller 30 requires that the transducer 139 provide a signal indicating that the lower portion of the pipe stand is securely held by the lower arm assembly 48.

Figures 28, 29:
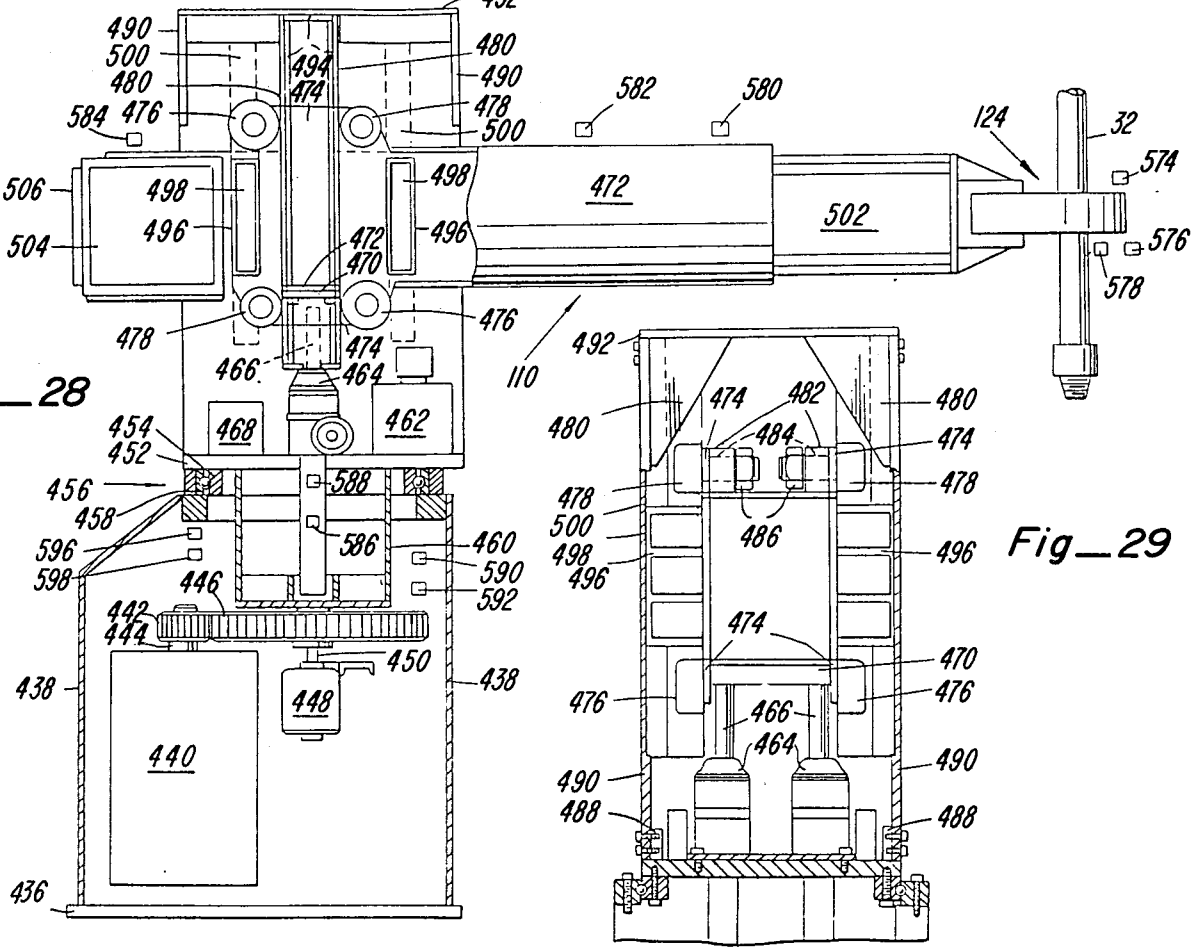
FIG. 28 is a side elevation with parts in section of another embodiment of a lower arm assembly.
FIG. 29 is a front elevation with parts removed and parts in section of the lower arm assembly.

Another embodiment of the lower arm assembly is illustrated in FIGS. 28 and 29. This embodiment comprises a base 436 which supports a housing 438 in which is mounted a drive means 440. A gear 442 is secured to the drive shaft 444 and is in mesh with and drives a larger gear 446. A resolver 448 is mounted below and operatively connected to the gear 446 by means 450 which rotates with the gear 446. The resolver 448 sends out a signal with the information relative to the rotary location of the lower arm assembly.

The lower arm assembly is supported for rotation therewith on a plate 452 which is secured to the inner race 454 of a bearing 456. The outer race 458 of the bearing is fixedly secured to the housing 438. Depending from and secured to the plate 452 is a connecting member 460 which is secured to the gear 446 for rotation therewith. Thus, rotation of the gear 446 results in corresponding rotation of the plate 452 and the lower arm assembly 48.

Mounted on the plate 452 is a drive means 462 operatively connected to a pair of spur gears 464 which are operatively associated with screw threaded members 466. A resolver 468 records the movement of the spur gears 464 and transmits a signal to provide information relative to the vertical location of the lower arm assembly.

A support plate 470 extends over and is secured to the ends of the screw threaded members 466. The housing 472 of the telescoping lower arm 110 is secured to the plate 470 for vertical movement with the screw threaded members 466. The sidewalls of the housing 472 are extended in each direction to provide support means 474 for a plurality of rollers 476 and 478. The rollers 476 are larger than the rollers 478 and provide the thrust resistance to overcome the weight of the pipe stand 32. The rollers 478 are adjustably mounted to so as to keep all the rollers 476 and 478 in engagement with a plurality of tracks 480. As illustrated, there are four rollers 476, four rollers 478 and four tracks 480. A plurality of blocks 482 are secured to the extensions 474 of the sidewalls and are provided with openings 484 extending therethrough. The shafts 486 of the rollers 476 and 478 extend through the openings 484 and are secured in position by suitable means, such as the nuts 486.

Two support blocks 488 are secured to the upper surface of the plate 452 and are spaced inwardly from the edges of the plate 452. A pair of opposed vertically extending support walls 490 are secured adjacent to their bottom edges to the support blocks 488. A top plate 492 is secured to the top ends of the support walls 490. A pair of inverted U-shaped support bases 494 are secured to opposite side walls 490 and have the tracks 480 secured thereto. A pair of weldments 496 are secured to the outer surfaces of the sidewalls of the housing 472 and a bearing block 498, preferably made from nylon, is seated in a cavity therein. The bearing block 498 extends a short distance out of the weldment and is received in a longitudinally extending recess 500 in each of opposite sidewalls 490. As illustrated, there are two recesses 500 in each sidewall and four blocks 498 for movement therein.

The extendable arm portion 502 is moved out of and into the housing 472 by suitable drive means 504. A resolver 506 is associated with the drive means 504 to record the movement of the extendable arm portion 502 and to transmit a signal to provide information relative to the location of the extendable arm portion 502. The end of the extendable arm portion 502 is provided with a clamp assembly 124 to support the pipe stand 32 as described above.

FIG. 28 also schematically shows a number of transducers for use in informing the programmable controller 30 as to the operation of the lower arm assembly 48. Specifically, transducer 574 is attached to the clamp assembly 124 and detects whether a pipe stand 32 is actually positioned within and held by the clamp assembly 124. Transducers 576, 578 inform the programmable controller whether the clamp assembly 124 is open or closed, repsectively. Transducer 580 informs the programmable controller 30 that the lower arm assembly 48 is extended to its maximum predetermined extension and should not go any further. Transducer 582 informs the programmable controller 30 that the lower arm assembly is in a position for pivotal movement towards the set-back assembly 50. And, similarly, transducer 582 provides an indication to the programmable controller 30 that the lower arm assembly 48 is in the proper position for rotating back towards the well hole after a pipe stand 32 is taken from the set-back assembly 50. Transducer 584 informs the programmable controller 30 that the lower arm assembly 48 has been retracted to its maximum predetermined position and should not be retracted any further. Transducer 586 informs the programmable controller 30 that the lower arm assembly 48 is pointed in the direction of the well hole so that the programmable controller 30 is informed as to whether the lower arm assembly 48 is in position for movement directly to the well hole for adding or uncoupling pipe stands 32. Transducer 588 provides an indication that the lower arm assembly 48 is directed towards the set-back assembly 50 so that the programmable controller 30 is able to control the transfer of lower portions of pipe stands 32 to the set-back assembly 50. The transducers 592, 594 inform the programmable controller 30 that the lower arm assembly 48 is extended or retracted, respectively, to its highest or lowest vertical position and should not be extended or retracted vertically any further. Similarly, the transducers 596, 598 inform the programmable controller 30 that the lower arm assembly 48 has reached its clockwise or counterclockwise rotational limit, respectively, and should not be rotated any further in that direction.

Figure 17:
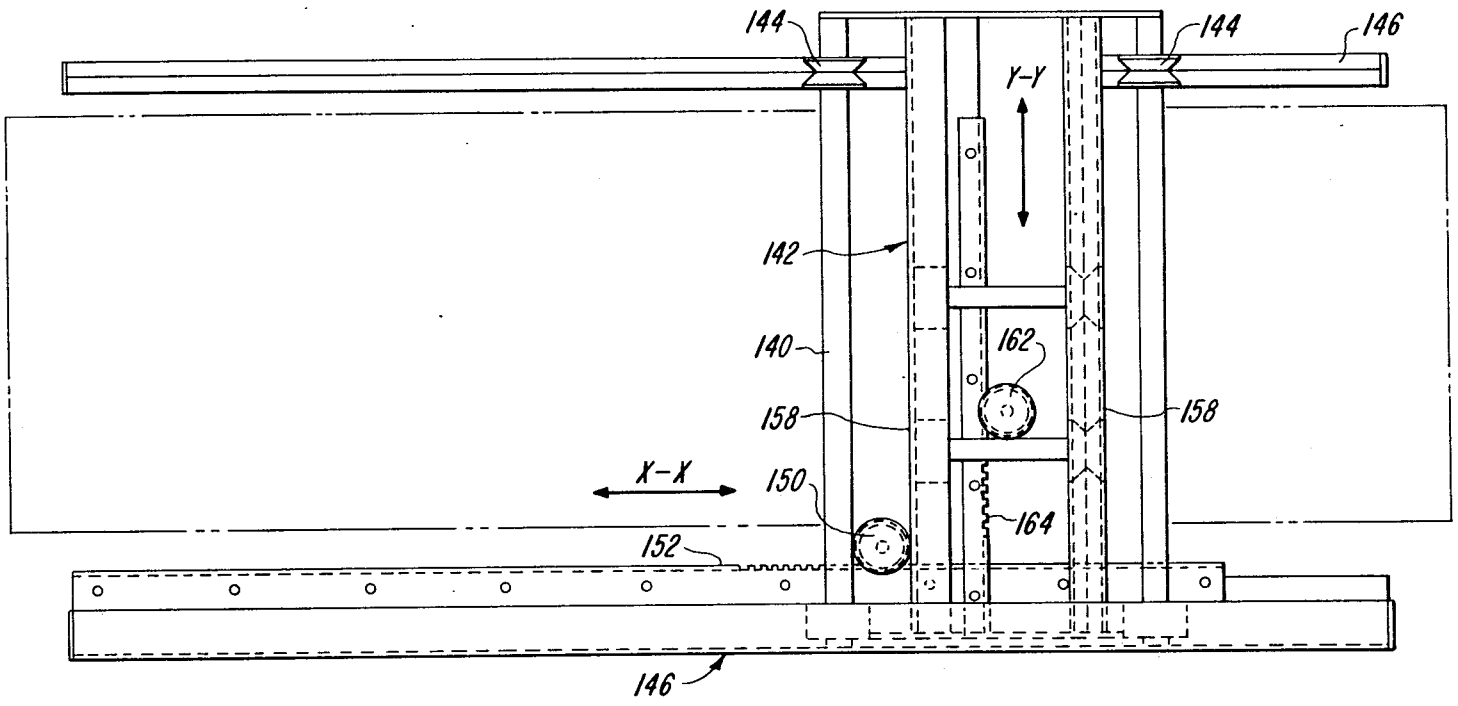
FIG. 17 is a top plan view of one of the sloping tracks of the set-back assembly with the cup removed.

The set-back or transport assembly 50 is shown in detail in FIGS. 16, 17 and 18, as well as being schematically illustrated in FIGS. 2A–2C through 7A–7C. As shown in FIGS. 16 and 17, the set-back assembly 50 includes a lower carriage 140 and an upper carriage 142. The lower carriage 140 is mounted on a first set of wheels 144 which ride on a first set of tracks 146 in a first or X-direction. The X-direction is illustrated in FIG. 17 and, as noted, the lower carriage 140 is movable along two opposite and aligned paths in the X-direction. For purposes of this discussion, a movement in a forward X-direction is defined as movement of the set-back assembly 50 in the X-direction towards the lower arm assembly 48, as positioned in FIGS. 2C through 7C. A movement in a rearward X-direction is defined as movement of the set-back assembly 50 in the X-direction away from the lower arm assembly 48, as positioned in FIGS. 2C through 7C. For example, with respect to FIG. 2C, the set-back assembly 50 was moved in a rearward X-direction from its standby position. The standby position of the set-back assembly 50 is a selected location thereof at which it receives an uncoupled pipe stand 32 from or delivers an uncoupled pipe stand 32 to the lower arm assembly 48.

A drive 148 coupled to a gear 150, which engages a rack 152 of the first set of tracks 146, is used to drive the lower carriage 140 in the X-direction. The upper carriage 142 is a generally inverted V-shaped structure having sloping legs 154. The upper carriage 142 is mounted on a second set of wheels 156 which ride on a second set of tracks 158. The second set of tracks 158 is mounted on the lower carriage 140. A drive 160 coupled to a gear 162, which engages a rack 164 of the second set of tracks 158, is used to move the upper carriage 142 in a second or Y-direction. This Y-direction is at right angles to the movement of the lower carriage 140 so that the set-back assembly 50 has complete movement in a horizontal plane. For purposes of this discussion, a movement in a forward Y-direction is defined as the movement of the set-back assembly 50 in the Y-direction towards the lower arm assembly 48, as positioned in FIGS. 2C through 7C. A movement in a rearward Y-direction is defined as a movement of the set-back assembly 50 in the Y-direction away from the lower arm assembly 48, as positioned in FIGS. 2C through 7C. For example, with respect to FIG. 2C, the set-back assembly 50 was moved in a rearward Y-direction from its standby position.

The X-direction and Y-direction can also be defined with respect to a rotary table used to rotate the drill string. The X-direction is a direction tangential to the rotary table and the Y-direction is a direction perpendicular to the rotary table.

Overlying each leg 154 of the upper carriage 142 is an inclined or sloping track 166, as seen in FIG. 18. Plates 168 are mounted to move along each track 166 using screw members 170 rotated by drives 172 through reduction gears 174. A bracket 176 is mounted on each plate 168. Each bracket 176 carries an open-sided cup or receptacle 178. As illustrated in FIG. 16, the cups 178 are used to receive the lower tapering portion of a pipe stand 32. The set-back assembly 50 also includes transducers 180 operatively fastened to the cups 178, one of the two identical transducers 180 being represented in FIG. 8. The transducers 180 sense whether a pipe stand 32 is fixedly held in the cup 178. The programmable controller 30 initiates movement of the set-back assembly 50 only after it has received an indication from a transducer 180 that a pipe stand 32 is properly in place. Prior to the set-back assembly 50 receiving a pipe stand 32 from the lower arm assembly 48, the programmable controller 30 also determines whether the set-back assembly 50 is in its standby or reference position. This determination by the programmable controller 30 can also be made using a transducer (not shown).

Figure 30:
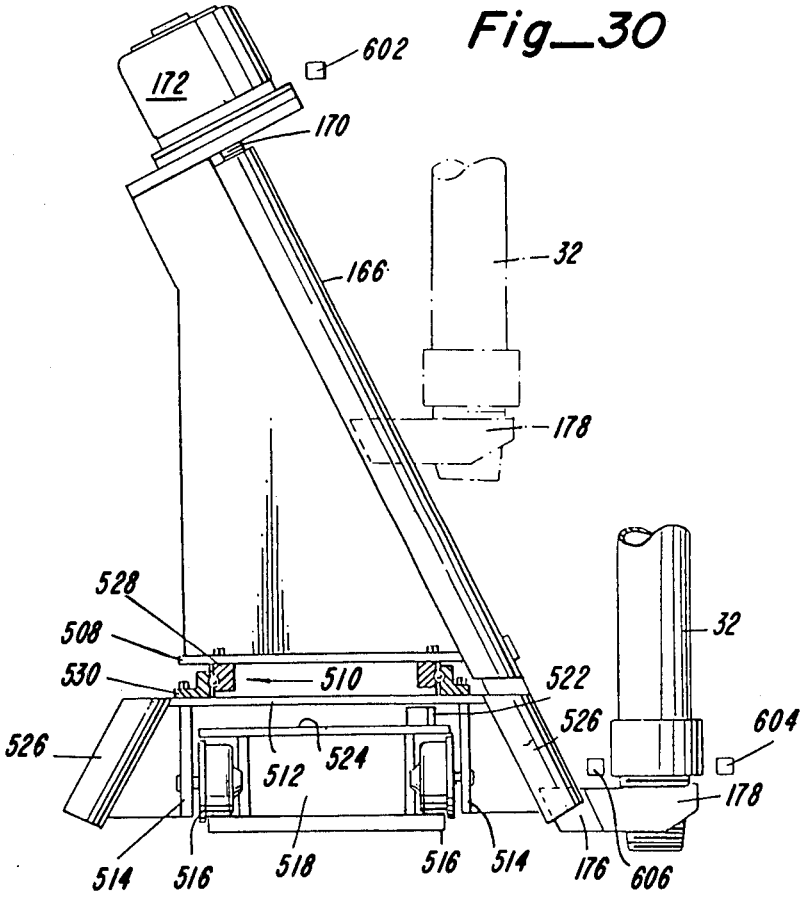
FIG. 30 is a front elevation with parts in section of another embodiment of an upper carriage for a setback assembly.

Another embodiment of an upper carriage of the set-back assembly 50 is illustrated in FIG. 30. The inclined track 166, the screw member 170, the drive motor 172, the bracket 176 and the cup 178 are all mounted on a plate 508. A bearing 510 is secured to base 512 of the carriage and depending from the base 512 are support members 514 to which the wheels 516 are mounted. A frame 518 is secured in a fixed location and provides a surface over which the wheels 516 may run. Rack 522 is secured to the upper surface 524 of the frame 518. Extensions 526 having the same structural characteristics as the track 166 are mounted on opposite sides of the base 512. Each extension 526 performs the function of the track in guiding the bracket 176 to a position adjacent to the support for the lower end rack of the pipe stands. The plate 508 is mounted on inner race 528 of the bearing 510 while the outer race 530 is fixedly secured to the base 508. Thus, the plate 508 may be rotated to move the inclined track 166, screw member 170, drive motor 172, bracket 176 and cup 178 from one side of upper carriage to the other side. Suitable means, such as a pin passing through aligned holes in the plate 508 and base 512 (not shown), may be used to secure the plate 508 at a desired location on either side of the upper carriage. A drive means (not shown) having a gear in engagement with the rack 522 is used to move the upper carriage to a desired location.

FIG. 30 also schematically shows a number of transducers for use in informing the programmable controller 30 as to the operation of the set-back assembly 50. Specifically, transducer 600 informs the programmable controller whether the pipe stand 32 is actually held in a cup 178. Transducer 602 informs the programmable controller 30 that the cup 178 is in the proper "up" position for receiving the lower portion of a pipe stand 32. Similarly, transducer 604 informs the programmable controller 30 that the cup 178 is in the desired "down" position for removal of the pipe stand 32 from the cup 178 onto the drill rig floor 36. In addition to these three transducers, the set-back assembly 50 utilizes a number of transducers (not shown) for providing information relating to the position of the set-back assembly 50. In particular, a transducer is provided to inform the programmable controller 30 as to whether the set-back assembly 50 is in the standby position along the X—X direction for receiving a pipe stand 32. Likewise, two transducers are provided to inform the programmable controller 30 as to whether the set-back assembly 50 is in the proper position in the Y—Y direction. One of these two transducers is used in checking for the proper standby position when the cup 178 is on one side of the upper carriage while the other of the two transducers is used to provide an indication of a proper standby position when the cup 178 is on the other side of the upper carriage. There are also four transducers used in error detection. Each of the four transducers is located along the ends of the track along which the set-back assembly 50 moves. As a result, the programmable controller 30 is informed when the set-back assembly 50 reaches each of the end positions of the tracks in both the X—X direction and the Y—Y direction.

In addition to the newly devised controlled devices previously identified as the upper arm assembly 44, finger board assembly 46, lower arm assembly 48, and set-back assembly 50, the present system also includes controlled and/or monitored devices in which conventional pipe drilling equipment has been uniquely modified for integration into the present invention. In particular, power slips 182, a pipe elevator 184, a power tong 186, a power spinner 188, drawworks 190, and brake 192 of FIG. 1 include newly incorporated hardware to permit controlling and monitoring thereof. In one embodiment, conventional power slips, pipe elevator, power tong and power spinner are available from Varco International, Inc. of Orange, Calif. conventional drawworks is available from Continental Emsco, a LTV Company of Dallas, Tex.; and a conventional brake is available from Dretech, a Dreco Company of Houston, Tex. Devices which are only monitored and not controlled by the programmable controller 30 and include newly incorporated hardware are a rotary table 194 and rig support systems 196 of FIG. 1.

Figure 19:
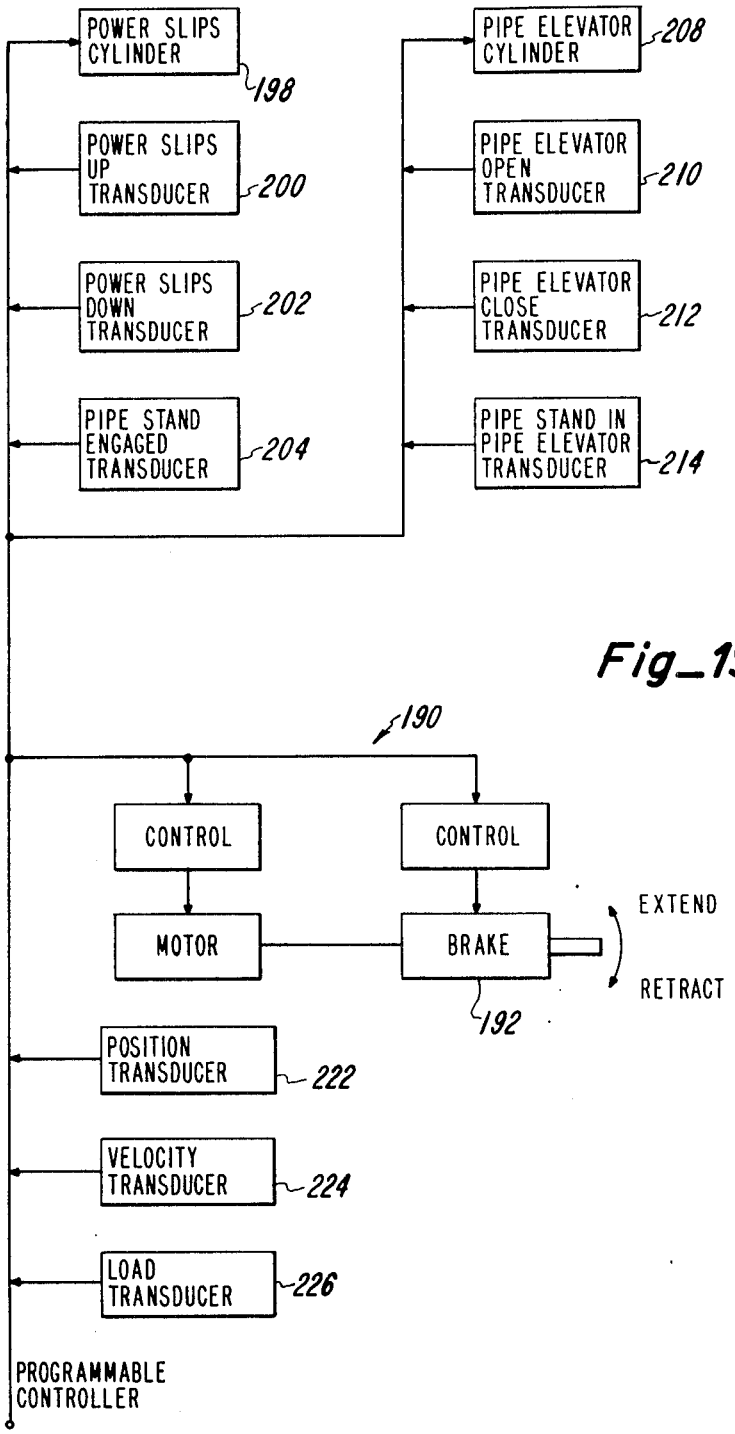
FIG. 19 is a block diagram representing cylinder-piston devices and transducers associated with the power slips, pipe elevator, drawworks, and brake.

The function of each of these controlled and/or monitored devices will now be described. With reference to FIGS. 1, and 19, the programmable controller 30 controls the functioning of the power slips 182. The power slips 182 are positioned at the opening in the drill rig floor 36 and are used to support pipe stands 32 located below the drill rig floor 36 by acting as a wedge between the rotary table 194 on drill rig floor 36 and the pipe stands 32. When a pipe stand 32 is to be coupled or uncoupled from other pipe stands 32, the power slips 182 are activated using the programmable controller 30 to fixedly grasp the top portion of the remaining coupled pipe stands 32 located below the drill rig floor 36 to support them during the coupling or uncoupling operation.

With reference to the schematic representation provided in FIG. 19 relating to the power slips 182, the programmable controller 30 controls a conventional pneumatic powered cylinder-piston device 198 which is operatively connected to the power slips 182 for use in causing movement of the power slips 182 towards or away from the top portion of the remaining pipe stands 32. This movement of the power slips 182 is sensed by transducers 200, 202. The outputs of the transducers 200, 202, which sense the movement of the power slips 182 towards the pipe stands 32 and away from the pipe stands 32, respectively, are transmitted to the programmable controller 30 so that the system is cognizant of the positioning of the power slips 182. In addition, a transducer 204 is operatively connected to the power slips 182 for sensing whether the power slips 182 have firmly engaged the top portion of the remaining coupled pipe stands 32. Only after this condition of engagement has been sensed and this sensed condition provided to the programmable controller 30 will the coupling or uncoupling operation begin. The cylinder-piston device 198 and transducers 200, 202, 204 are incorporated on conventional power slips for use in creating automated power slips 182.

The programmable controller 30 also controls the functioning of the pipe elevator 184, as depicted in block form of FIG. 1. The pipe elevator 184 is used to engage the top portion of pipe stands 32 which are to be coupled to or uncoupled from the remaining coupled pipe stands 32 located below the drill rig floor 36. This engagement of a pipe stand 32 by the pipe elevator 184 is represented schematically in FIGS. 2A, 3A and 4A. The pipe elevator 184 acts like a mechanical hand. The opening and closing of this hand is regulated by the programmable controller 30 which controls a pneumatically powered cylinder-piston device 208, which is represented schematically in FIG. 19. To monitor the operation of the pipe elevator 184, three transducers 210, 212, 214 are utilized. Transducer 210 senses whether the pipe elevator 184 is being opened while transducer 212 senses whether the pipe elevator 184 is being closed. Transducer 214 senses whether a pipe stand 32 is firmly grasped by the pipe elevator 184. Each of the outputs of the transducers 210, 212, 214 is inputted to the programmable controller 30. The pipe elevator 184 is moved vertically with a pipe stand 32 only after transducer 214 indicates to the programmable controller 30 that the upper end of a pipe stand 32 is firmly engaged by the pipe elevator 184. Transducers 210, 212, 214 are incorporated on a conventional pipe elevator for use in creating an automated pipe elevator 184.

The vertical movement of the pipe elevator 184 results from the operation of a drawworks 190 and a brake 192, both of which are represented in block form in FIG. 1. The drawworks 192 is basically a hoisting system which provides the power and hardware for use in raising and lowering pipe stands 32. The drawworks 190 includes a winch (not shown) and cable 218, as depicted in FIGS. 2A through 7A. The cable 218 is connected to a block and hook 220. The block and hook 220 is attached to the pipe elevator 184. The brake 192 is connected to the winch of the drawworks 190. The brake 192 acts to control the amount of weight or load acting on a drill bit attached to the drill string and also controls where the drill bit will stop when the drill string is moved vertically in the well. The brake 192 assists in supporting the weight of the drill string in order to control the positioning of the drill bit in the well so that drilling will take place along a desired path.

In conjunction with drawworks 190 and brake 192, transducers 222, 224, 226 are provided for sensing desired parameters associated with the movement of the pipe elevator 184 and the drill string connected thereto. This sensed information is transmitted to the programmable controller 30. This information enables the programmable controller 30 to place the pipe elevator 184 in the desired position so that pipe stands 32 can be gripped by the upper and lower arm assemblies 44, 48 and for positioning pipe stands 32 for the coupling and uncoupling operation provided by the power tong 186 and power spinner 188. A schematic representation of portions of the conventional drawworks 190 and brake 192, together with the transducer modifications communicating therewith, is provided in FIG. 19.

Transducer 222 is used in providing an indication to the programamble controller 30 of the position of the pipe elevator 184 relative to the drill rig floor 36. Transducer 224 is used in providing an indication of the velocity of the pipe elevator 184 when it is moved in a vertical or up/down direction. Transducer 226 is used in providing an indication of the drill string weight or load on the pipe elevator 184. Using this information and appropriate software, the programmable controller 30 is able to determine whether positional changes of the drill string in the well should be made, based, e.g., on a comparison with predetermined or desired positions, velocities, and weights.

The programmable controller 30 also controls the functioning of the power tong 186 and the power spinner 188. The power tong 186 includes a number of cylinder-piston devices 230, 232, 234, 236, 238, 240, 242, 244, 246, as represented schematically in FIG. 20. The cylinder-piston devices 230–246 are hydraulically powered and the function of each is set forth in the schematic representations of FIG. 20. The functions of a conventional power tong are well-known in the art. Each cylinder-piston device 230–246 is modified in that a retracted transducer (RT) and an extended transducer (ET) is operatively joined thereto. Additionally, the programmable controller 30 communicates with the cylinder-piston devices 230–246 to control the extension/retraction thereof when desired. The present system thereby modifies a conventional power tong by incorporating extended and retracted transducers, together with transducers 245, 247, 249, and 251, in communication with the programamble controller 30 to create the automated power tong 186.

Figure 20:
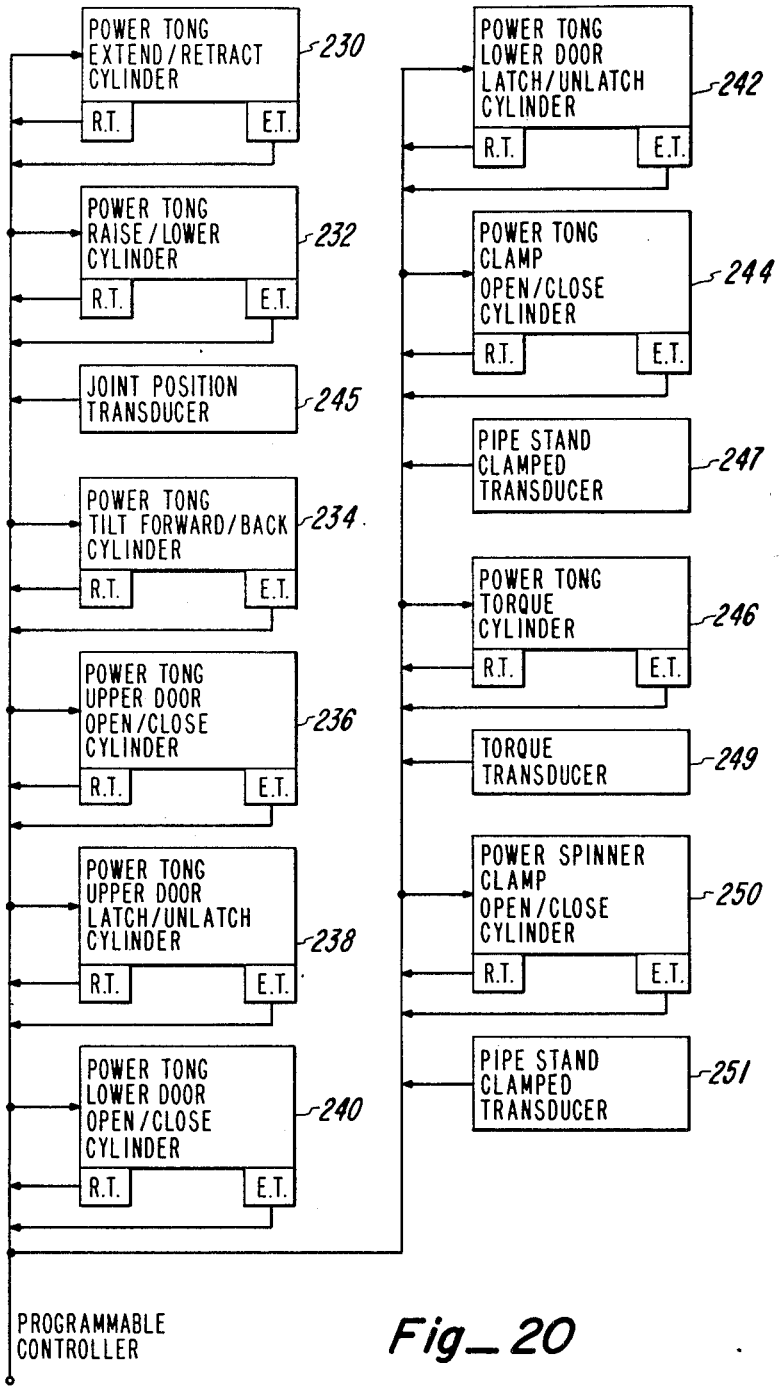
FIG. 20 is a block diagram representing cylinder-piston devices and transducers associated with the power tong/power spinning unit.

Referring to FIG. 20, the cylinder device 230 is used to move the power tong 186 towards and away from the well hole along tracks to place it in position for coupling and uncoupling pipe stands 32. The extended and retracted transducers associated with the device 230 inform the programmable controller 30 when the power tong 186 is at the well hole or in its retracted state away from the well hole. The cylinder device 232 is used to raise and lower the power tong 186 and the power spinner 188 unit so that it can be properly aligned with the coupling joint of two adjacent pipe stands 32. The extended and retracted transducers associated with the device 232 inform the programmable controller 30 as to the raised or lowered position of the unit. The cylinder device 234 is also controlled by the programmable controller 30 and is used when the power tong/power spinner unit connects the Kelly bushing to the uppermost stand of pipe 32. The extended and retracted transducers of this cylinder device 234 inform the programmable controller 30 as to whether the power tong 186 is in its forward or back position during the operation of the cylinder device 234.

The power tong 186 includes upper and lower doors as well as a latch for each door. Prior to receiving a pipe stand 32, the doors must be unlatched and opened. The cylinder devices 236, 238 open the upper door and unlatch the door, respectively. Their associated transducers sense whether the upper door is open or closed and whether the upper door is latched or unlatched. Similarly, the cylinder devices 240, 242 are controlled by the programmable controller 30 and are used to open and unlatch, respectively, the lower door. Their associated transducers provide an indication to the programmable controller 30 as to whether the lower door is opened or closed and whether the lower door is latched or unlatched. The cylinder device 244 is also controlled by the programmable controller 30 and is used to open and close the clamp for holding the pipe stand 32 to be removed from or added to other pipe stands 32. The extended and retracted transducers associated therewith provide an indication to the programmable controller 30 as to whether the clamp is opened or closed. The cylinder device 246 is used to provide torque to the pipe stand 32 for uncoupling or coupling the same to adjacent pipe stands 32. The transducers associated therewith inform the programmable controller 30 as to whether the cylinder device 246 is in a position to provide torque or has finished its torque cycle.

In addition to the extended and retracted transducers associated with the various cylinder devices 230–246, transducer 245 informs the programmable controller 30 as to whether the power tong 186 is in the proper position for coupling or uncoupling adjacent pipe stands 32. The transducer 247 provides an indication to the programmable controller 30 as to whether a pipe stand 32 is in fact clamped or held by the power tong 186. The torque transducer 249 of the power tong 186 is a pressure switch for detecting when the power tong 186 has applied the maximum torque to the pipe stand 32 for making the joint between the two pipe stands 32.

In the case wherein the power tong 186 has initially broken the coupling joint between adjacent pipe stands 32, the power spinner 188 is next utilized to complete the uncoupling of the adjacent pipe stands 32. The power spinner 188 includes a cylinder-piston device 250, represented schematically in FIG. 20, and which is controlled by the programmable controller 30 for use in opening or closing a spinner clamp of the power spinner 188. The extended and retracted transducers associated therewith inform the programmable controller 30 as to whether the clamp is opened or closed. As illustrated schematically in FIG. 5A, the spinner clamp, upon closing, is used to engage and hold a pipe stand 32 near the coupling joint. A transducer 251 is operatively connected to a conventional power spinner 188 in order to provide an indication to the programmable controller as to whether the spinner clamp has in fact engaged the pipe stand 32 before permitting uncoupling or coupling of the pipe stand 32.

After the spinner clamp has engaged the pipe stand 32 adjacent to the coupling junction, a hydraulically powered spinner motor 252, schematically illustrated in FIG. 8, of the power spinner 188 is activated, using the programmable controller 30, for use in threadedly coupling or uncoupling the adjacent pipe stands 32, depending upon whether a pipe stand 32 is being added or removed.

In the case of uncoupling adjacent pipe stands 32, the monitoring of whether these pipe stands 32 are completely disconnected is provided by transducer 254 (pin out), see FIG. 8 for schematic representation. In one embodiment, transducer 254 senses whether any "gap" is present between adjacent pipe stands 32. If a gap is present, a signal is provided by the transducer 254 to the programmable controller 30 indicating that the adjacent pipe stands 32 are no longer connected. In a similar manner, a transducer 256 (pin in) informs the programmable controller 30 when the spinner motor 252 has completed its task during the coupling operation and the power tong 186 can then be used to provide the necessary torque to secure the joint.

In addition to controlling as well as monitoring the aforementioned devices, the programmable controller 30 also monitors equipment commonly provided in a drilling operation. As represented in FIG. 1, the programmable controller 30 monitors the functioning of a rotary table 194. During drilling, the rotary table 194 is operatively connected to the drill string or drill column. The rotary table 194 is powered to rotate in a horizontal plane by a motor located below the drill rig floor 36 and this rotational movement is transferred to the drill string in order to rotate the drill bit. The rotary table 194 is monitored to determine whether it is activated and moving. For example, if the rotary table 194 is activated, the operation for removing or adding pipe stands 32 is inhibited to enhance safety.

The programmable controller 30 also monitors various other drilling conditions, identified in the block diagram of FIG. 1 as rig support systems 196. Since the present invention is intended to be a complete controlling and monitoring system in conjunction with the safe removal and addition of pipe stands 32, such conditions as the magnitudes of hydraulic and pneumatic pressures, the operating states of mud pumps, and the presence of poisonous gases in the vicinity of the drilling operation are monitored. In addition to these conditions, it is understood that many other drilling related conditions or parameters can be monitored and an indication thereof be provided using the programmable controller 30 and appropriate software utilized therewith. Typically, the specifications or wishes of each individual drilling user can be accommodated to provide the desired monitoring function.

Another newly-devised device of the present invention, which is represented in the block form of FIG. 1, is an intrusion safety system 258. This system is utilized to maximize safety during the removal and addition of pipe stands 32. The intrusion safety system 258 is both monitored and controlled by the programmable controller 30. The intrusion safety system 258 includes, for example, a number of sensing devices for determining whether a drill rig operator or workman is located within a defined area, including, for example, the area occupied by the upper arm assembly 44, finger board assembly 46, lower arm assembly 48, set-back assembly 50, power slips 182, pipe elevator 184, power tong 186, and power spinner 188. If a drill rig operator is situated in such an area, the programmable controller 30 is programmed to automatically terminate system operation to minimize possible human injury in the defined area.

OPERATION

The operation of the present invention is now described with reference in particular to FIGS. 2A–2C through 7A–7C, which schematically illustrate the removal of a pipe stand 32 from the drill column. The sequence of steps involved in removing pipe stands 32 is known in the drilling industry as "tripping out". In a typical case, tripping out of pipe stands 32 is necessary to replace a worn drill bit. Consequently, a number of pipe stands 32 must be uncoupled and stacked or stored so that the drill bit can be raised from the well and replaced.

Figure 2A:
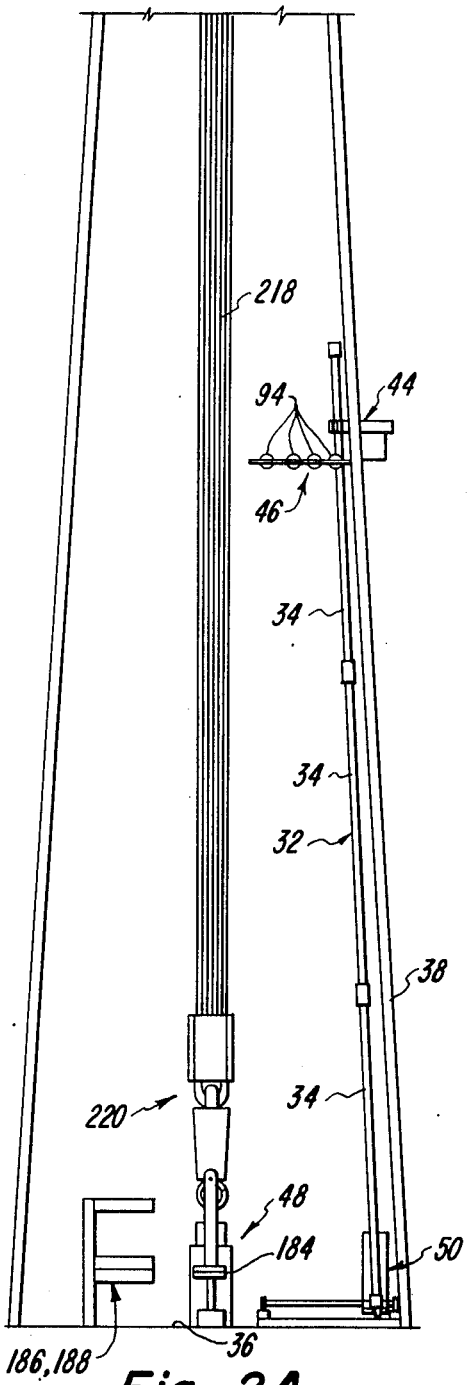
FIGS. 2A–2C are schematic representations showing the pipe elevator grasping a pipe stand.

Before initiating the actual tripping out operation, some preparatory work is done. Specifically, a Kelly or square piece of tubing and a bushing joined to the upper end of the uppermost pipe stand 32, extending upwardly from the drill rig floor 36, are disconnected from this uppermost pipe stand 32 end, raised a short distance using the pipe elevator 184, and are then stored in a location commonly known as a rathole. After the Kelly and bushing are stored, they are disconnected from the pipe elevator 184. The drawworks 190 is activated so that the cable 218 and pipe elevator 184 are lowered to engage the upper portion of the pipe stand 32 which is extending out of the drill rig floor 36. The pipe elevator 184 firmly grasps the upper portion of the pipe stand 32, as illustrated in FIG. 2A. When the transducer 214 senses that the pipe stand 32 is fixedly held by the pipe elevator 184, the drawworks 190 is activated to raise the pipe stand 32 to a predetermined height.

It is significant to note that the programmable controller 30 is programmed to verify the proper occurrence of each of the sequence of steps taken in coupling or uncoupling pipe stands 32, using the various transducers and drives. Before any further action is permitted or the next step taken, this verification is made. By way of example, the output of transducer 214 is sent to the programmable controller 30 to provide an indication as to whether the pipe stand 32 is held by the pipe elevator 184. If an indication is not provided verifying that the pipe stand 32 was engaged, the next step is not carried out.

After the pipe stand 32 is at the desired position, the power slips 182 are activated by the programmable controller 30 so that they will engage and support the pipe stands 32 beneath the drill rig floor 36. The transducer 204 provides a signal to the programmable controller 30 to indicate that the power slips 182 have properly engaged these pipe stands 32.

Figure 3A:
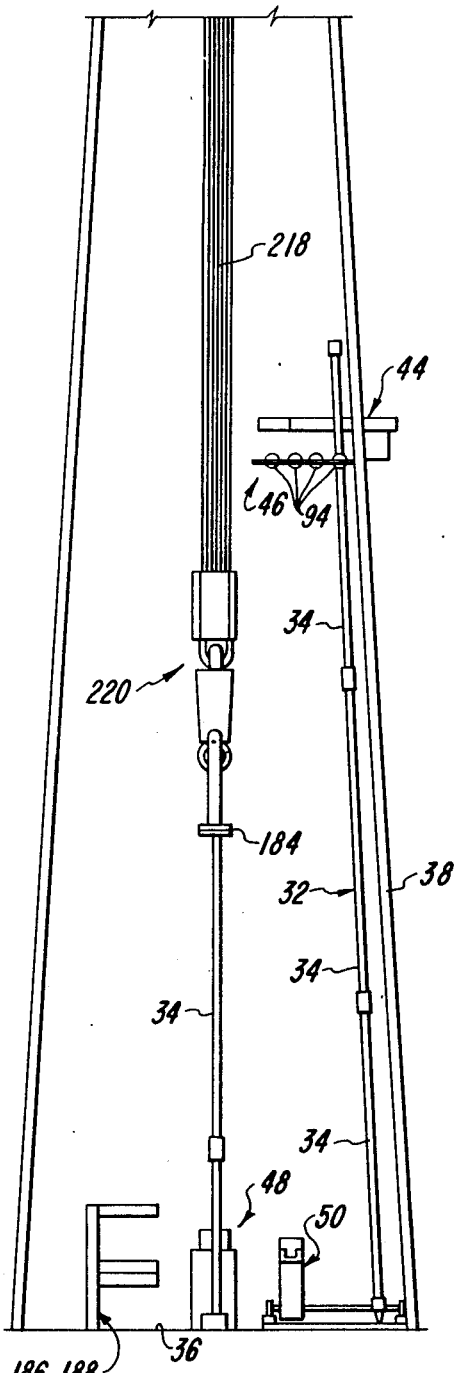
FIGS. 3A–3C are schematic representation showing the pipe elevator raising the grasped pipe stand.
Figure 3B:
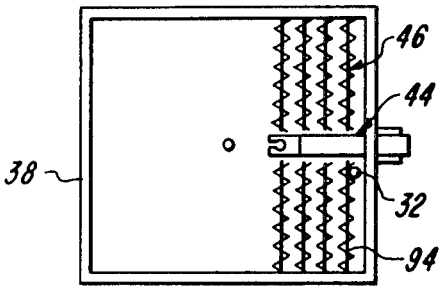

During the raising of the pipe stand 32, the upper arm assembly 44 is also activated and begins to extend from its standby retracted position, as illustrated in FIGS. 3A and 3B. When the raised pipe stand 32 is at the predetermined height, the third extendable portion 62 of the upper arm assembly 44 is positioned so that the jaws 72 thereof are located about an upper portion of the pipe stand 32. During the extension of the upper arm assembly 44, the drive 80 is providing information to the programmable controller 30 indicating the horizontal position of the upper arm assembly 44. Upon reaching the predetermined horizontal position, the drive 80 is deactivated. At this time, the drive 74 is energized so that the jaws 72 of the upper arm assembly 44 begin to grasp the upper portion of the pipe stand 32. When the upper arm assembly 44 has loosely engaged the pipe stand 32, the transducer 84 provides a signal to the programmable controller 30 indicating that the pipe stand 32 is held by the upper arm assembly 44.

Figure 4A:
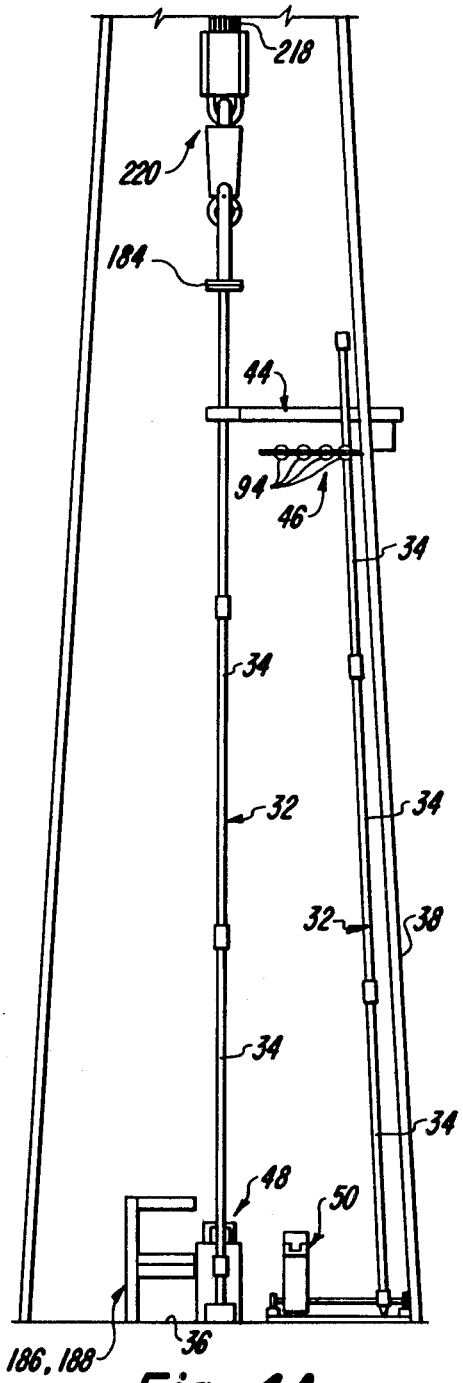
FIGS. 4A–4C are schematic representations showing the upper arm assembly grasping a top portion of the grasped pipe stand.
Figure 4B:
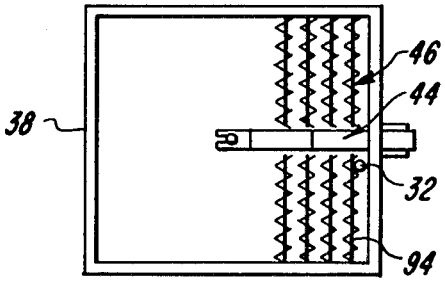

Also at this time, in a typical operation, the lower arm 110 of the lower arm assembly 48 is being extended, using the drive 114, towards the lower portion of the pipe stand 32. Similar to the operation of the upper arm assembly 44, the drive 114 is continuously providing information to the programmable controller 30 regarding the horizontal position of the lower arm 110. Consequently, when the lower arm assembly 48 is positioned for grasping the lower portion of the pipe stand 32, its extension is halted, as depicted in FIGS. 4A and 4B. The drive 138 is then activated to cause the jaw slips 132 of the lower arm assembly 48 to close around the pipe stand lower portion and loosely engage the pipe stand 32 in order to permit rotation thereof.

Figure 3C:
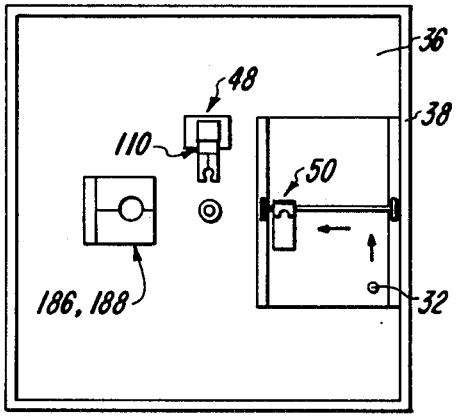
Figure 4C:
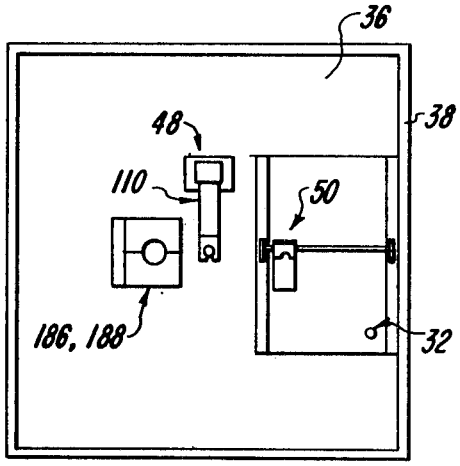
Figure 5A:
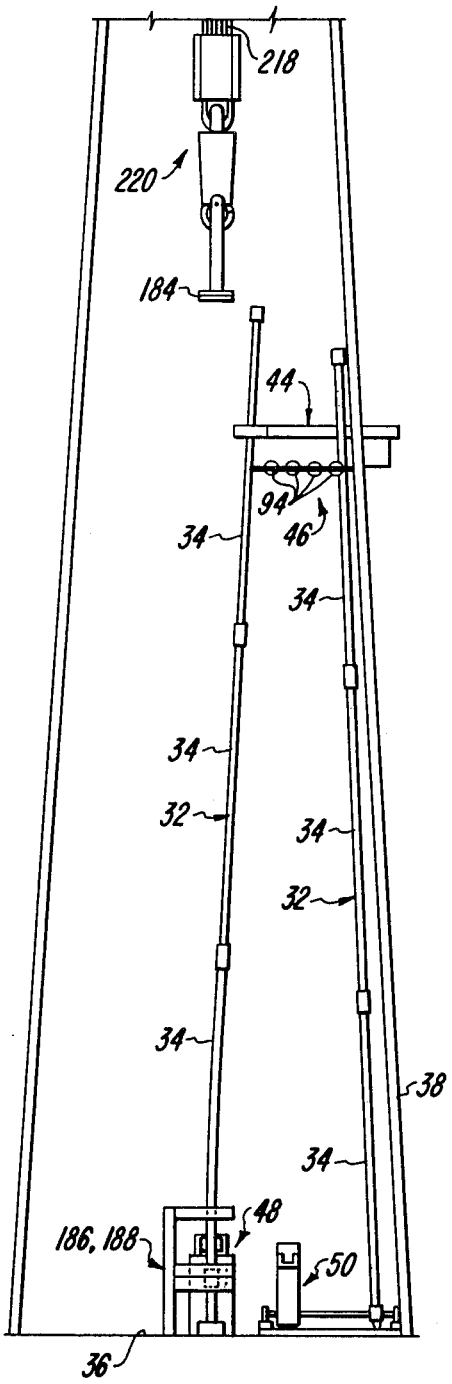
FIGS. 5A–5C are schematic representations showing the upper arm assembly retracting with the grasped pipe stand while the lower arm assembly grasps a bottom portion of the pipe stand.
Figure 5B:
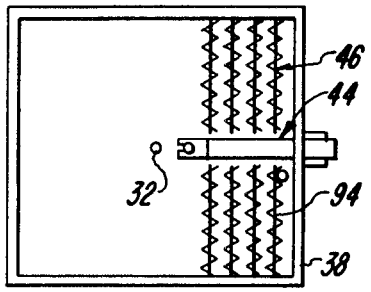
Figure 5C:
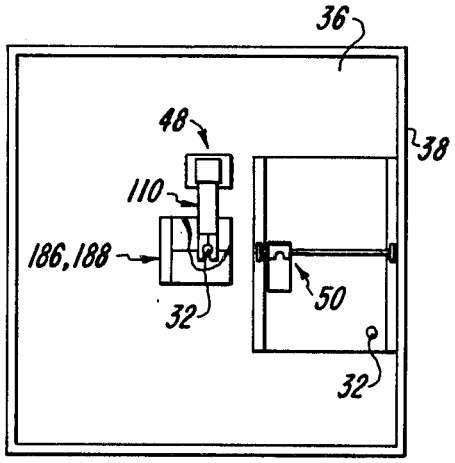
Figure 6A:
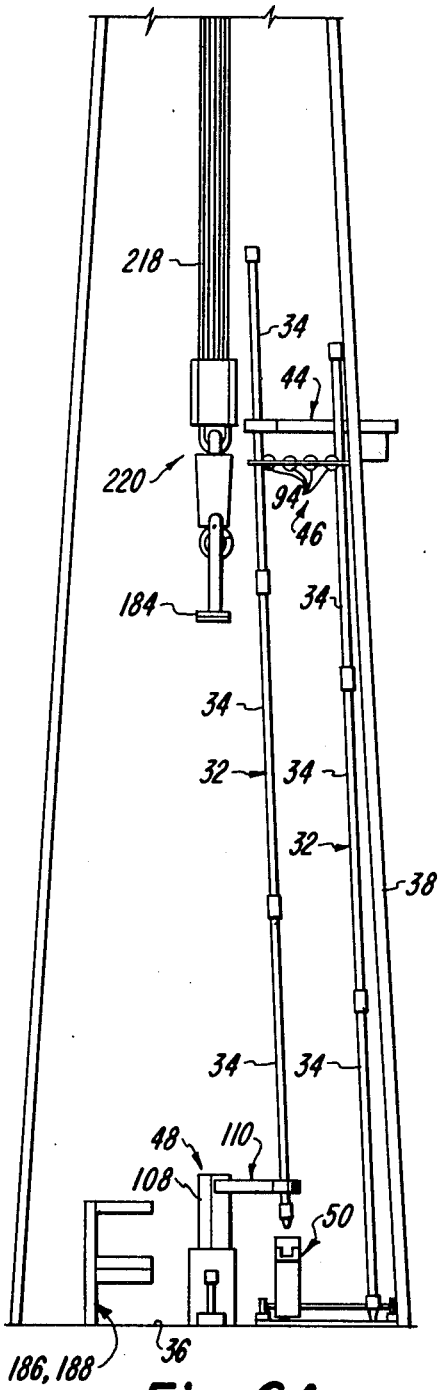
FIGS. 6A–6C are schematic representations showing vertical and horizontal movements of the lower arm assembly.
Figure 6B:
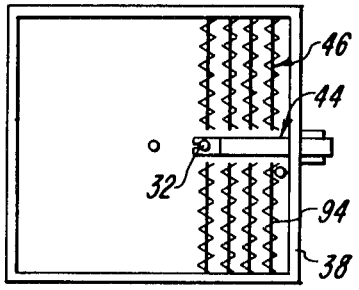
Figure 6C:
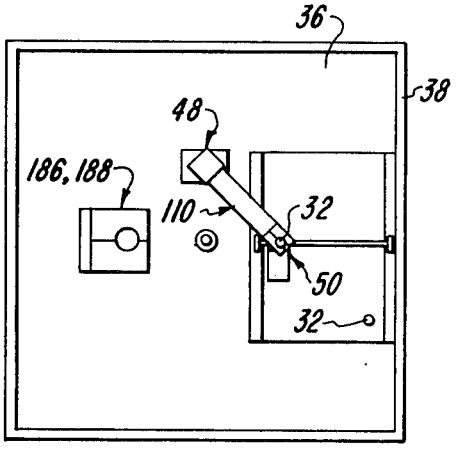
Figure 7A:
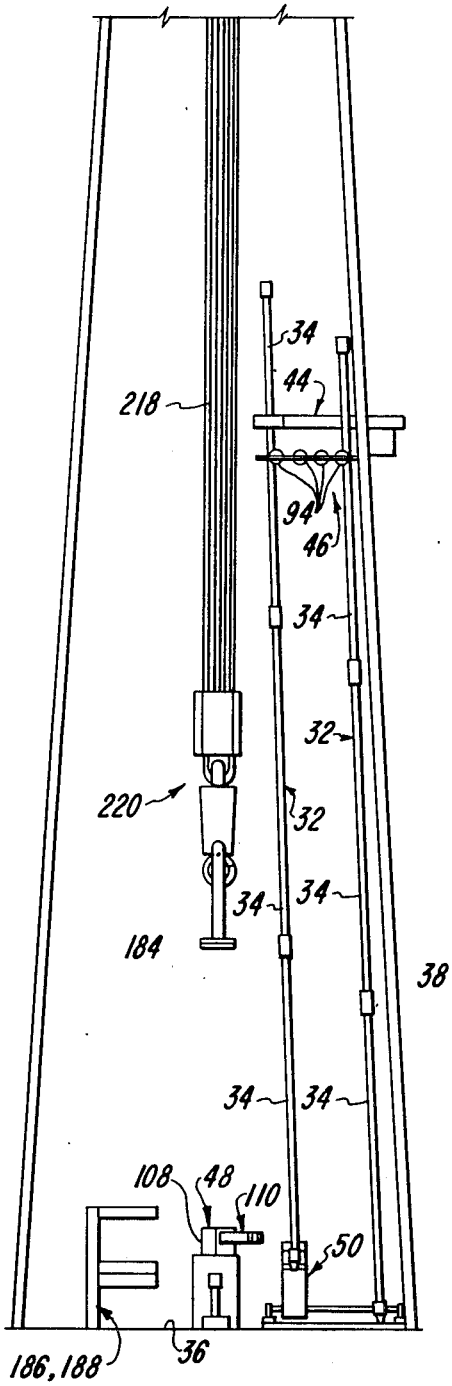
FIGS. 7A–7C are schematic representations showing the pipe stand being received by the set-back assembly.
Figure 7B:
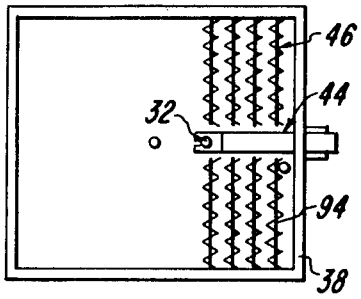
Figure 7C:
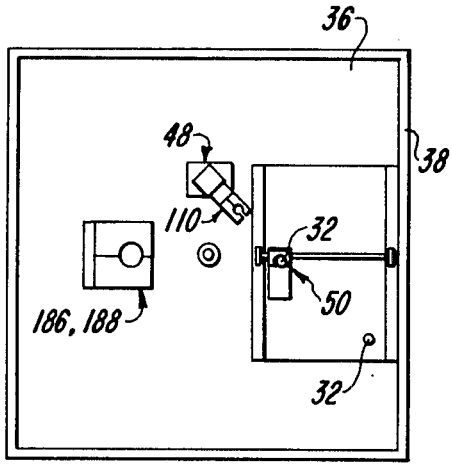

During the engagement of the pipe stand 32 by the upper arm assembly 44 and lower arm assembly 48, the power tong 186 and power spinner 188 are moved in a direction towards the pipe stand 32, as represented in FIGS. 4A and 4C. The power tong 186 and power spinner 188 are represented as a single unit in FIGS. 2A through 7C. As illustrated in FIGS. 5A and 5C, the power tong 186 and the power spinner 188 are in position to uncouple adjacent pipe stands 32. In moving the power tong 186 and power spinner 188, two different means may be employed. In a first embodiment, with the power tong 186 and power spinner 188 in a single unit, two different means may be employed. In a first embodiment, the single unit power tong 186 and power spinner 188 is moved along tracks. In a second embodiment, the power tong 186 and power spinner 188 include extendable/retractable portions, which are hydraulically movable, to engage the pipe stands 32.

After this preliminary work is completed, the tripping out operation can begin. In this regard, the programmable controller 30 initiates a sequence of steps to control one or more of the cylinder-piston devices 230–246 in order to initially break the coupling at the junction of the two pipe stands 32. After the initial breaking of the coupling, the programmable controller 30 activates the spinner motor 252 in order to completely uncouple the raised pipe stand 32 from the remaining pipe stands 32 extending below the drill rig floor 36. During the uncoupling using the spinner motor 252, the programmable controller 30 is continually monitoring transducer 254. When the adjacent pipe stands 32 are uncoupled or separated, the transducer 254 senses the resulting gap between the two pipe stands 32 and provides a signal to the programmable controller 30 indicating that the adjacent pipe stands 32 are now uncoupled. At this time with the pipe stand 32 uncoupled, the programmable controller 30 activates the lower arm 110 by energizing drive 118 to move the lower arm 110 in an upward direction so that the jaw slips 132 are wedged against the pipe stand 32 and the lower portion of the pipe stand 32 is firmly gripped. At this time the transducer 139 of lower arm assembly 48 indicates that the uncoupled or removed pipe stand 32 is firmly engaged for movement of the pipe stand 32. The programmable controller 30 now continues to activate drive 118 to raise the lower arm 110 so that the removed pipe stand 32 is moved vertically away from the remaining coupled pipe stands 32.

In addition, during the uncoupling operation at the junction of the adjacent pipe stands 32, the pipe elevator 184 is activated by the programmable controller 30 through the cylinder-piston device 208 so that it releases the upper end of the pipe stand 32, as seen in FIG. 5A. Also at this time, the upper arm assembly 44 beings to retract so that the upper portion of the uncoupled pipe stand 32 and the lower portion thereof are not in vertical alignment. Vertical alignment is attained when the drive 116 is activated to swing the lower arm 110, which is gripping the lower portion of the pipe stand 32, above the set-back assembly 50. During this pivotal movement of the lower arm 110, the drive 116 is continuously providing information to the programmable controller 30 regarding its position. Also, the programmable controller 30 is monitoring the position of the set-back assembly 50 and, in particular, the position of the selected one of the two cups 178 which is to receive the lower end of the removed pipe stand 32. The cup 178 is located essentially at the top of the leg 154 of the inverted V-structure in order to receive the pipe stand 32. If an unwanted condition should occur in which the cup 178 is not in this proper position or if the set-back assembly 50 is not in its standby position, the programmable controller 30 discontinues further operation until the unwanted condition is corrected.

In the expected event that the set-back assembly 50 and the cup 178 are in proper position, the lower arm 110 eventually pivots sufficiently to place a lower portion of the pipe stand 32 into the open side of the cup 178. The transducer 180 operatively connected to the set-back assembly 50 senses that the received pipe stand 32 is now held by the cup 178 and sends an indication to the programmable controller 30. The programmable controller 30 then activates the lower arm 110 so that it is lowered to disengage the jaw slips 132 from the pipe stand 32, the jaws 134 are opened, and the lower arm 110 is then pivoted and retracted to its position for engaging another pipe stand 32.

The upper arm assembly 44 and the set-back assembly 50 now cooperate to maintain the removed pipe stand 32 in a substantially vertical attitude as it is moved on upper carriage 142 in a rearward Y-direction on the tracks 158. The amount of movement in the Y-direction depends upon where the removed pipe stand 32 is to be stored on the drill rig floor 36. With respect to the illustrations provided in FIGS. 2 and 3, this removed pipe stand 32 is to be stored in substantially the lowermost right hand corner of the stored area. As a consequence, the upper carriage 142 is moved along the set of tracks 158 in a rearward Y-direction to the ends of the set of tracks 158. Simultaneously, the upper arm assembly 44 is retracted so that the upper end portion of the pipe stand 32 remains in substantially vertical alignment with the lower end portion of the pipe stand 32.

When the removed pipe stand 32 is positioned at the desired location in a Y-direction, the programmable controller 30 activates the drive 68. The drive 68 causes the wrist 64 to pivot in the programmed direction which is, in the present example, towards the finger board section 86. The degree of pivotal movement is predetermined such that the pipe stand 32 is now positioned adjacent to the end of the selected screw conveyor 94 which is to receive the uncoupled pipe stand 32. At the completion of the predetermined pivoting of the wrist 64, the drive 68 remains activated to now cause the extendable wrist portion 67 to extend parallel and adjacent to the selected screw conveyor 94. At the same time the extendable wrist portion 67 is being extended, the selected screw conveyor 94 is making one-half turn. At the completion of the predetermined extension of the extendable wrist portion 67 and the one-half turn of the selected screw conveyor 94, the servomotor 74 is activated to open the jaw 72 and to release the pipe stand 32 to the available helicoidal surface 95. Upon releasing the pipe stand 32 to be held in the helicoidal surface 95, the servomotor 68 is once again activated to retract the extendable wrist portion 67. At the completion of the predetermined retraction of the extendable wrist portion 57, the wrist 64 pivots to its previous position so that the upper arm 52 can again be extended to engage the next pipe stand 32 to be uncoupled.

Figure 2B:
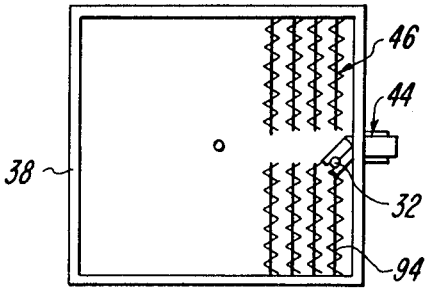
Figure 2C:
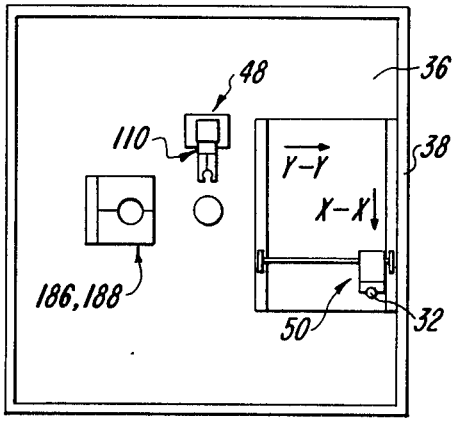

Referring to the schematic representations of FIGS. 2A–2C, while the upper arm assembly 44 is returned to its standby position, the set-back assembly 50 is moved in the rearward X-direction so that the lower portion of the removed pipe stand 32 can be placed in the lowermost right hand corner or position of the storage area. At this position, the bracket 176 and cup 178 holding the lower portion of the pipe stand 32 are moved downwardly along the sloping track 166 of the upper carriage 142. When the cup 178 is positioned at the lower end of the sloping track 166, its open side can be separated laterally from the lower end of the pipe stand 32. This allows the set-back assembly 50 to be moved in the forward X-direction so that the lower portion of the pipe stand 32 is removed therefrom and is supported on the drill rig floor 36.

During the time that the set-back assembly 50 is moving the lower end portion of the pipe stand 32, the pipe elevator 184 is once again lowered to receive the next pipe stand 32 to be uncoupled. Upon releasing the first removed pipe stand 32, the set-back assembly 50 is moved to its standby or reference position, as seen in FIG. 3C, for receiving the next-to-be removed pipe stand 32.

The foregoing process is continued in a manner such that each screw conveyor 94 of the first finger board section 86 receives one pipe stand 32. After that, each screw conveyor 94 of the first finger board section 86 receives a second pipe stand 32 in a selected manner. This method of filling the screw conveyors 94 continues until all of the screw conveyors 94 of the first finger board section 86 are filled with pipe stands 32. In accomplishing this, each of the pipe stand upper portions is placed into the selected screw conveyor 94 and a half-turn of the screw conveyor 94 is made with delivery of each removed pipe stand 32 thereto by the extendable wrist portion 67. The lower portions of the pipe stands 32 are moved to their predetermined positions on the surface of the drill rig floor 36. When a screw conveyor 94 becomes completely filled with removed pipe stands 32, each upper portion of each stored pipe stand 32 will once again be in vertical alignment with its lower portion since the screw conveyor 94 moves all upper portions of pipe stands 32 one-half turn each time one additional pipe stand 32 is received by the screw conveyor 94. Consequently, at the time the selected screw conveyor 94 has rotated to position a pipe stand 32 in an open helicoidal surface located at the end of the screw conveyor 94 opposite that end to which the upper arm assembly 44 delivers pipe stands 32, that pipe stand 32 is substantially vertical.

If all available helicoidal surfaces 95 of all screw conveyors 94 of the first finger board section 86 are filled with removed pipe stands, the set-back assembly 50 is used to carry additionally removed pipe stands 32 in a forward X-direction opposite that of the rearward X-direction. Specifically, the other of the two cups 178 is now selected to receive the lower portion of the removed pipe stand 32 and the wrist 64 of the upper arm assembly 44 pivots in the opposite direction to place the removed pipe stand 32 into a screw conveyor 94 of the second finger board section 88. In such a manner, both finger board sections 86, 88, together with the underlying drill rig floor 36, can be filled in a predetermined manner with removed pipe stands 32.

In moving the set-back assembly 50 to the predetermined position for releasing of the lower portion of the pipe stand 32, the programmable controller activates drives 148, 160. These two drives 148, 160 also provide the active feedback to the programmable controller 30 to enable it to determine whether the set-back assembly 50 is at the desired position. When each predetermined X,Y position is reached by the set-back assembly 50, the programmable controller 30 deactivates the appropriate servomotor drive 148, 160. As with previously discussed movement controls in the present system, appropriate software can be devised to properly position all controlled devices, including the set-back assembly 50.

With respect to coupling or adding pipe stands to the remaining pipe stands 32, generally known in the field as "tripping in", the foregoing process is essentially reversed. In this regard, typically, the last screw conveyor 94 accessed to receive a removed pipe stand 32 is the first to be activated in order to place the upper portion of the pipe stand 32 in a position to be received by the jaws 72 of the upper arm assembly 44. The set-back assembly 50 is also positioned to receive this last-to-be-removed pipe stand 32. After the upper arm assembly 44 and set-back assembly 50 have moved the pipe stand 32 so that the set-back assembly 50 is in its standby position, the lower arm assembly 48 can be activated to engage the lower portion of the pipe stand 32 and move it into alignment with any remaining pipe stands 32 extending below the drill rig floor. The power tong 186 and power spinner 188 are utilized to couple together the adjacent pipe stands 32 while the upper portion of the to-be-coupled pipe stand 32 is moved using the upper arm assembly 44 to align it with the pipe elevator 184. The pipe elevator 184 engages the upper portion of the to-be-coupled pipe stand 32. After the coupling is completed at the lower portion thereof, the power slips 182 are released from holding that pipe stand 32 to which the pipe stand 32 has just been coupled. The pipe stand elevator 184 raises the drill string slightly to transfer the weight of the drill string to the pipe elevator 184. The pipe elevator 184 is then lowered by the drawworks 190 so that the newly added pipe stand 32 is lowered below the drill rig floor 36. In such a manner, additional pipe stands 32 can be removed from storage and coupled to the remaining pipe stands 32 for placement below the drill rig floor 36.

It is also understood that various other particular sequences of accessing the screw conveyors 94 can be provided using software. For example, in order to possibly better equalize the use and wear of each of the pipe stands 32, a sequence of pipe stand 32 selection can be devised which will provide this desired result, such as the last pipe stand 32 uncoupled from the drill string is not the first pipe stand 32 to be recoupled to the drill string.

During the uncoupling and coupling of pipe stands 32, the programmable controller 30 is also continuously monitoring drilling-related equipment, such as the rotary table 194 and rig support systems 196. If a predetermined fault condition should be received by the programmable controller 30, the software takes immediate and appropriate action, e.g., shutting down or terminating the system operation. As discussed previously, in addition to monitoring these pieces of equipment, the programmable controller 30 also monitors the operation of the controlled devices, such as the upper arm assembly 44, finger board assembly 46, lower arm assembly 48, set-back assembly 50, power slip 182, pipe elevator 184, power tong 186, power spinner 188, drawworks 190, brake 192, and intrusion safety system 258. If a predetermined fault condition should occur relating to any one of these controlled devices, or if one or more of these devices should fail to function properly, the software instructed programmable controller 30 takes immediate and appropriate action.

In addition to the automatic control provided by the present invention, the present system also provides for semi-automatic operation so that an operator or workman has the capability to override the fully automated system and directly control the functioning of the hardware equipment. In particular, the upper arm assembly 44, finger board assembly 46, lower arm assembly 48, and set-back assembly 50 can be separately controlled. Also, the power slips 182, pipe elevator 184, power tong 186, and power spinner 188 can also be separately controlled thereby overriding the complete automatic control provided by the programmable controller 30.

Means are also provided whereby each of the upper arm assembly 44, finger board assembly 46, lower arm assembly 48, set-back assembly 50, and other controlled or sensed devices can be disabled in one or more different combinations. Thus, if a disabling fault should occur in one of the controlled or sensed devices, the remaining devices can be selectively utilized by means of the programmable controller 30 in non-automated sequences to enable continued operation in a "semi-automated" mode.

Additionally, means are provided, in case of faults, so that portions of the system of the present invention can be operated manually, i.e., mechanically by hand, such as lever and ratchet mechanisms (not shown), in order to provide the capability to continue with operation of the system.

Based on the foregoing detailed description, a number of worthwhile features of the present invention are discerned. An automated pipe handling system including verification means is provided which significantly minimizes the number of workmen required to accomplish the tripping out and tripping in functions associated with drilling. Concomitantly, the safety of workmen is greatly enhanced since they need not be directly involved in the coupling and uncoupling operation. Moreover, pertinent parameters and conditions relating to the drilling operation are monitored so that fault conditions can be indicated to advise the workmen of the existence of any such fault conditions and further minimize possible human injury. The present system provides for intervention by an operator when required and is intended to utilize, as far as possible, conventional drilling equipment to reduce the cost of automation. In addition, the present invention maximizes repeatability of operation, reduces operational and maintenance costs, and increases the capability of faster handling and moving of pipe.

Although the present invention has been described with reference to specific embodiments thereof, it is readily understood that further variations and modifications can be effected within the spirit and scope of this invention.

What is claimed is:

1. A method for use in storing uncoupled pipes on a platform, comprising the steps of:

grasping one pipe to allow rotational movement thereof;

uncoupling the one pipe from adjacent pipe;

grasping the one pipe to prevent rotational movement thereof;

detecting that the one pipe is grasped before moving the pipe;

providing transport means that occupies substantially less space on the platform than that occupied by stored pipes;

moving the lower portion of the one pipe to said transport means;

releasing the lower portion of the one pipe to said transport means;

transporting the lower portion of the one pipe to its final storage position by moving said transport means over the platform before receiving a succeeding pipe; and removing the lower portion of the one pipe from said transport means for storing the one pipe.

2. A method, as claimed in claim 1, further including:

moving the upper portion of the one pipe to a predetermined position relative to a rotatable device;

rotating the rotatable device in securely hold the upper portion of the one pipe; and continuing rotation of said rotatable device to move the upper portion of the one pipe while maintaining the lower portion of the one pipe in its final storage position.

3. A method, as claimed in claim 1, wherein:

said transport means includes movable receptacle means having an open side and said releasing step includes locating said receptacle means in a relatively upward position and releasing the lower portion of the one pipe to said movable receptacle means; and said removing step includes moving said receptacle means in a downward direction and moving said transport means in a direction away from the one pipe wherein the lower portion of the one pipe is separated from said receptacle means through said open side.

4. A method for use in storing uncoupled pipes, comprising the steps of:

positioning a lower arm assembly on a substantially horizontal platform for gripping a lower portion of one pipe, said lower arm assembly including a lower arm which is rotated in a horizontal plane towards and away from the one pipe;

positioning an upper arm assembly for gripping an upper portion of pipe;

using transducers to sense whether the upper and lower arm assemblies have gripped pipe;

moving pipe using the lower and upper arm assemblies, after said transducers provide an indication that pipe has been gripped;

transferring the lower portion of the pipe to a transport assembly having receptacle means using said lower arm, said transport assembly occupying substantially less space than the space occupied by stored pipes;

detecting by said receptacle means as to whether said receptacle means has received the one pipe;

moving said transport assembly including said receptacle means over said platform to a predetermined position.

* * * * *